US012606356B2

(12) United States Patent
Merzeau et al.

(10) Patent No.: US 12,606,356 B2
(45) Date of Patent: Apr. 21, 2026

(54) ARTICLE CARRIER AND BLANK THEREFOR

(71) Applicant: WestRock Packaging Systems, LLC, Atlanta, GA (US)

(72) Inventors: Julien Merzeau, Châteauroux (FR); Pascal Martini, Le Poinçonnet (FR); Jean-Michel Garnier, Issoudun (FR); Lauren N. Chesnet, Henrico, VA (US); Jonathan Lyon, Joliet, IL (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/693,874

(22) PCT Filed: Sep. 21, 2022

(86) PCT No.: PCT/US2022/044298
§ 371 (c)(1),
(2) Date: Mar. 20, 2024

(87) PCT Pub. No.: WO2023/049220
PCT Pub. Date: Mar. 30, 2023

(65) Prior Publication Data

US 2024/0327086 A1 Oct. 3, 2024

Related U.S. Application Data

(60) Provisional application No. 63/246,926, filed on Sep. 22, 2021.

(51) Int. Cl.
*B65D 71/42* (2006.01)

(52) U.S. Cl.
CPC .... *B65D 71/42* (2013.01); *B65D 2571/00444* (2013.01); *B65D 2571/0066* (2013.01)

(58) Field of Classification Search
CPC ..... B65D 2571/00882
See application file for complete search history.

(56) References Cited

U.S. PATENT DOCUMENTS 3,493,261 A * 2/1970 Stout ..... B65D 71/16 294/87.2
4,637,515 A * 1/1987 Wilson ..... B65D 71/30 206/427

(Continued)

FOREIGN PATENT DOCUMENTS

CA 2189766 10/1996
EP 0048506 A1 3/1982

OTHER PUBLICATIONS

International Search Report for International Application No. PCTUS2244298, dated Dec. 12, 2022, 3 pages.

*Primary Examiner* — Bryon P Gehman
(74) *Attorney, Agent, or Firm* — Brian J. Goldberg; Rohini K. Garg; Tsugihiko Suzuki

(57) ABSTRACT

Aspects of the disclosure relate to an article carrier (90; 290; 490) for packaging one or more articles and to a blank (10; 110; 210; 310; 410) for forming the carrier. The carrier comprises a main panel (12; 112; 212, 222; 312, 322A, 322B; 412, 422A, 422B) including an article retention structure (RT; RT1, RT2) having an article receiving opening defined in part by at least a pair of opposing engaging tabs (40, 42; 140, 142; 240, 242, 246, 248; 340, 342, 346, 348; 440, 442, 446, 448) each having a length (L1, L2) greater than a half of the distance (L3) between their hinged connections (13A, 41; 213, 215, 241, 247, 249; 313, 315, 341, 347, 349; 413, 415, 441, 447, 449) to the main panel (12; 112; 212, 222; 312, 322A, 322B; 412, 422A, 422B).

23 Claims, 12 Drawing Sheets

(56) References Cited

U.S. PATENT DOCUMENTS

| | | | | | |
|---|---|---|---|---|---|
| 4,681,217 | A | * | 7/1987 | Hernandez | B65D 71/30 206/427 |
| 4,815,599 | A | * | 3/1989 | Schuster | B65D 71/14 206/427 |
| 5,407,065 | A | * | 4/1995 | Sutherland | B65D 71/44 206/427 |
| 5,960,945 | A | * | 10/1999 | Sutherland | B65D 71/42 206/427 |
| 6,223,892 | B1 | | 5/2001 | Bakx | |
| 7,789,231 | B2 | | 9/2010 | Requena | |

* cited by examiner

ARTICLE CARRIER AND BLANK THEREFOR

CROSS-REFERENCE TO RELATED APPLICATIONS

The present application is a 35 U.S.C. §§ 371 national stage application of PCT/US2022/044298 filed on 21 Sep. 2022, which claims the benefit of priority to U.S. Provisional Patent Application Ser. No. 63/246,926 filed on 22 Sep. 2021, the contents of each of which are incorporated herein by reference in their entirety.

TECHNICAL FIELD

The present invention relates to article carriers and blanks for forming the same. More specifically, but not exclusively, the invention relates to a carrier of the top-gripping type having one or more apertures for receiving and retaining an article therein.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel and are arranged about the aperture. The tabs are displaced out of the plane of said panel when an article is received in the aperture, wherein said tabs engage the article generally about a flange or lip of the article.

It is desirable to provide a cover to protect an upper end of the article or to provide a display panel for display of information.

The present invention seeks to provide an improvement in the field of packaging, of cartons, typically formed from paperboard or the like, and apparatus for assembly of said cartons.

SUMMARY

A first aspect of the invention provides an article carrier for packaging at least one article. The carrier comprises a main panel having at least one top-engaging device for engaging an article. The top-engaging device has an article receiving opening and at least a pair of opposing engaging tabs. Each of the at least a pair of opposing engaging tabs have a length greater than a half of the distance between their hinged connections to the main panel.

Beneficially, this enables the engaging tabs to extend further from the main panel this may be advantageous when packaging articles having long neck portions separating a main body from an end closure such as, but not limited to, beverage bottles. The main panel can be located at elevation closer to the main body, this may reduce or eliminate spreading or splaying of article within a group of articles. A restraint in the form of strap or band may be provided for encircling the group of articles about the main body portions of the articles, the restraining strap may be hingedly connected to the main panel. This arrangement may be materially efficient, reducing the quantity of substrate material to provide the blank and/or article carrier.

A second aspect of the invention provides an article carrier for packaging at least one article. The carrier comprises a main panel having at least one top-engaging device for engaging an article. The top-engaging device comprises at least a pair of opposing engaging tabs each having a length greater than a half of the distance between proximal ends of the opposing engaging tabs. Each of the pair of opposing engaging tabs is struck from the main panel. The proximal ends oppose engaging edges of the pair of opposing engaging tabs. Each of the pair of opposing engaging tabs extends from its proximal end substantially straight to its distal end Optionally, the proximal end of at least one of the pair of opposing engaging tabs is defined, at least in part, by a hinged connection in the main panel.

Optionally, the hinged connection couples the at least one of the pair of engaging tabs to the main panel.

Optionally, the proximal end of at least one of the pair of opposing engaging tabs is defined by a notional line which is colinear with the hinged connection which couples a secondary panel to the main panel.

A third aspect of the invention provides an article carrier for packaging at least one article. The carrier comprises a main panel having at least one top-engaging device for engaging an article. The top-engaging device comprises at least first and second engaging tabs. The first tab comprises a distal portion formed from the second tab such that the distal portion remains in the plane of the remainder of the first tab when a free end of the distal portion is brought into engagement with an article.

Optionally, the first tab is frangibly connected to the second tab by a frangible connection provided at the free end of the distal portion.

A fourth aspect of the invention provides an article carrier for packaging at least one article. The carrier comprises a main panel having at least one top-engaging device for engaging an article. The top-engaging device comprises at least first and second engaging tabs. The first tab comprises at least a portion formed from a recessed area of the second tab such that the second tab and a free end of the at least a portion of the first tab engages the same article when the article carrier is in use.

Optionally, the recessed area of the second tab is dimensioned to receive a portion of the article received in the at least one top-engaging device.

A fifth aspect of the invention provides an article carrier for packaging at least one article. The carrier comprises a main panel having at least one top-engaging device for engaging an article. The top-engaging device comprises at least first and second engaging tabs. The first tab comprises at least a portion formed from a recessed area of the second tab. The first tab is disposed adjacent to a side panel hinged to the main panel.

Optionally, the first tab is connected to the side panel. Optionally, the first tab is hinged to the side panel. Optionally, the first tab is integral or unitary with the side panel.

A sixth aspect of the invention provides an article carrier for packaging at least one article. The carrier comprises a first primary panel and at least one second primary panel each having at least one top-engaging device. Each top-engaging device comprises at least a pair of opposing engaging tabs. Each tab of the pair of opposing engaging tabs has a length greater than a half of the distance between their hinged connections to the respective one of the first and second primary panels.

Optionally, the first primary panel comprises at least one first top-engaging device and the at least one second primary panel has at least one second top-engaging device, the tabs of the at least one second top-engaging device are oriented perpendicularly to the tabs of the at least one first top-engaging device.

Optionally, the first primary panel comprises a tab receiving recess for receiving a respective one of the tabs of the at least one second top-engaging device.

Optionally, the tab receiving recess is defined between a pair of lobes.

Optionally, the tab receiving recess is defined in part by a portion of each of the pair of opposing engaging tabs in the first primary panel.

Optionally, the first primary panel comprises a pair of diametrically opposed tab receiving recesses.

Optionally, each of the pair of diametrically opposed tab receiving recesses is defined in part by a portion of each of the pair of opposing engaging tabs in the first primary panel.

Optionally, the at least one second primary panel comprises a pair of second primary panels each having at least one top-engaging device.

Optionally, a first one of the pair of second primary panels is disposed in at least partial overlapping relationship with a second one of the pair of second primary panels.

Optionally, the overlapping pair of second primary panels each provide a portion of a three-ply handle structure.

Optionally, at least one of the pair of second primary panels comprises a recess configured to be disposed in registry with at least a portion of an aperture or opening in the first primary panel.

Optionally, a recess is provided in one of the pair of second primary panels and is aligned with an opening of a top-engaging device in the other of the pair of second primary panels.

Optionally, the recess comprises a curved edge portion shaped to accommodate an article received in the top-engaging device.

Optionally, the top-engaging devices in the pair of second primary panels comprise at least one slot.

Optionally, the top-engaging devices in the pair of second primary panels comprise a pair of slots defining side edges of the pair of opposing engaging tabs.

A seventh aspect of the invention provides a blank for forming an article carrier. The blank comprises a main panel having at least one top-engaging device for engaging an article. The top-engaging device has an article receiving opening and at least a pair of opposing engaging tabs each having a length greater than a half of the distance between their hinged connections to the main panel.

An eighth aspect of the invention provides a blank for forming an article carrier. The blank comprises a main panel having at least one top-engaging device for engaging an article. The top-engaging device comprises at least a pair of opposing engaging tabs each having a length greater than a half of the distance between proximal ends of the opposing engaging tabs. Each of the pair of opposing engaging tabs is struck from the main panel. The proximal ends oppose engaging edges of the pair of opposing engaging tabs.

A ninth aspect of the invention provides a blank for forming an article carrier. The blank comprises a main panel having at least one top-engaging device for engaging an article. The at least one top-engaging device comprises at least first and second engaging tabs. The first tab comprises a distal portion formed from the second tab such that the distal portion remains in the plane of the remainder of the first tab when a free end of the distal portion is brought into engagement with an article in a setup carrier.

A tenth aspect of the invention provides a blank for forming an article carrier. The blank comprises a main panel having at least one top-engaging device for engaging an article. The at least one top-engaging device comprises at least first and second engaging tabs. The first tab comprises at least a portion formed from a recessed area of the second tab such that the second tab and a free end of the at least a portion of the first tab engages the same article when the article carrier is in use.

An eleventh aspect of the invention provides a blank for forming an article carrier. The blank comprises a main panel having at least one top-engaging device for engaging an article. The at least one top-engaging device comprises at least first and second engaging tabs. The first tab comprises at least a portion formed from a recessed area of the second tab, wherein the first tab is disposed adjacent to a side panel hinged to the main panel.

A twelfth aspect of the invention provides a blank for forming an article carrier. The blank comprises a first primary panel and at least one second primary panel each having at least one top-engaging device. Each top-engaging device comprises at least a pair of opposing engaging tabs. Each tab of the pair of opposing engaging tabs has a length greater than a half of the distance between their hinged connections to the respective one of the first and second primary panels.

Further features and advantages of the present invention will be apparent from the specific embodiments illustrated in the drawings and discussed below.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks, and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks, and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
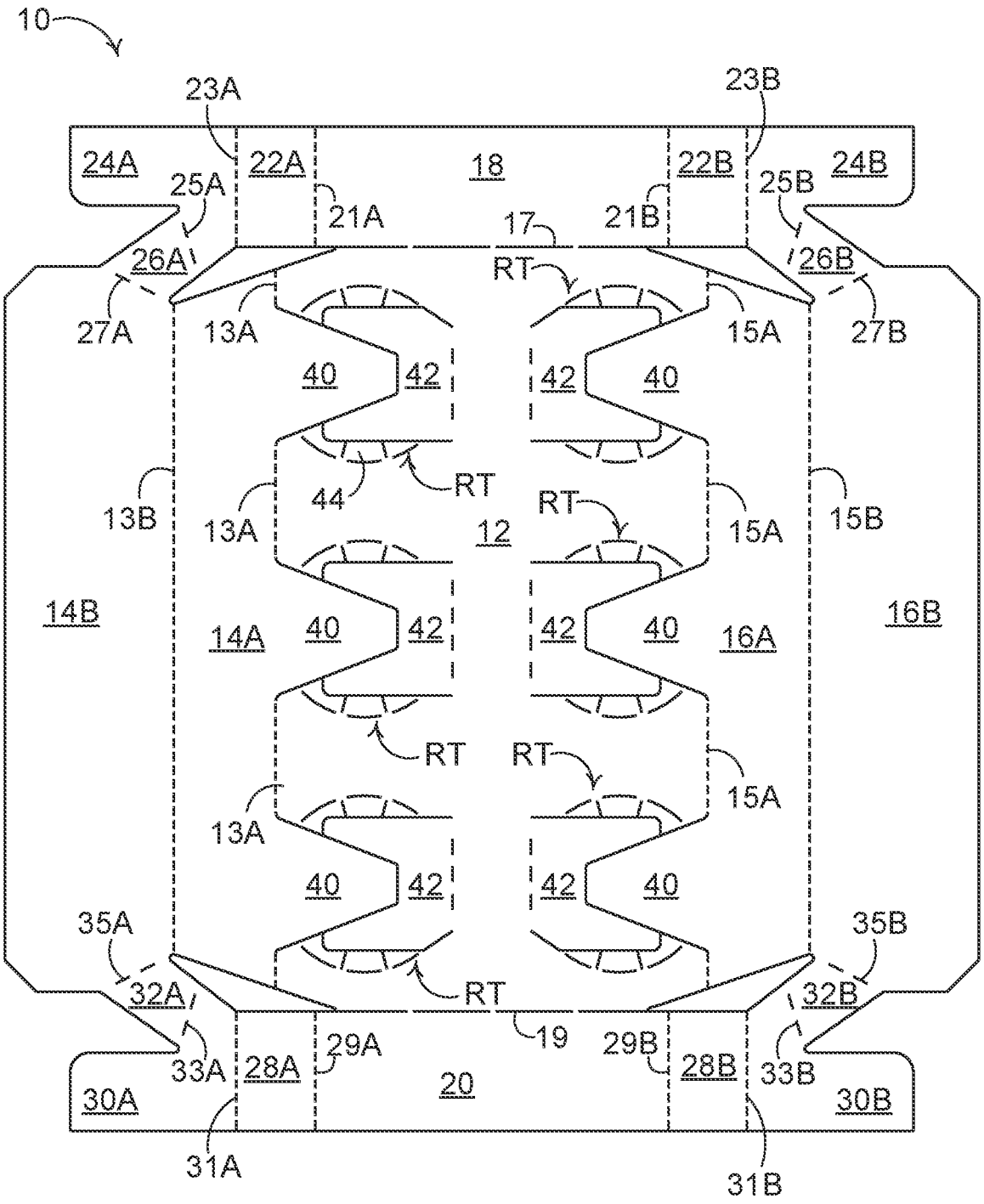
FIG. 1 is a plan view from above of a blank for forming a carrier according to an embodiment of the present disclosure.
Figure 2:
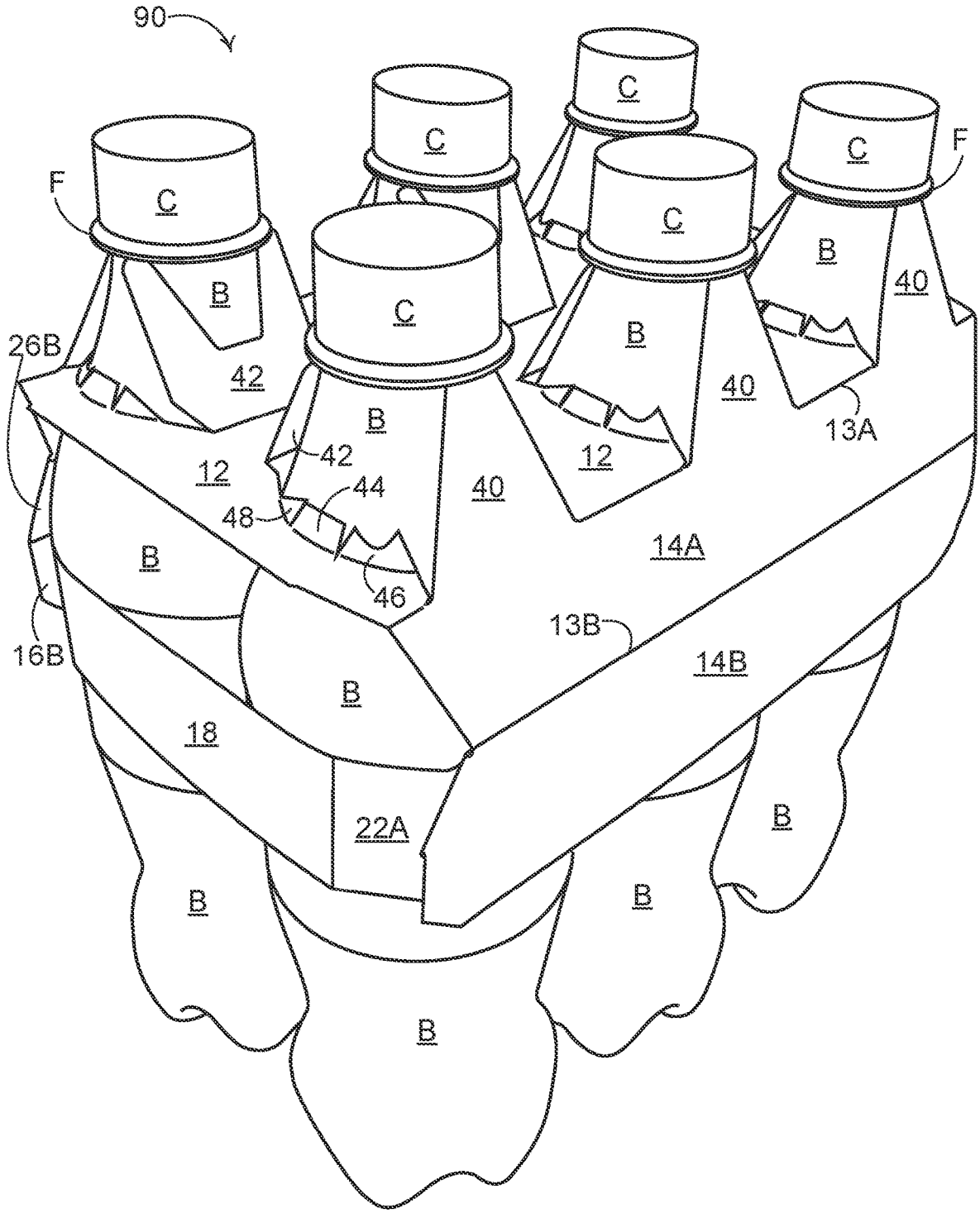
FIG. 2 is a perspective view from above of a carrier formed from the blank of FIG. 1.
Figure 9:
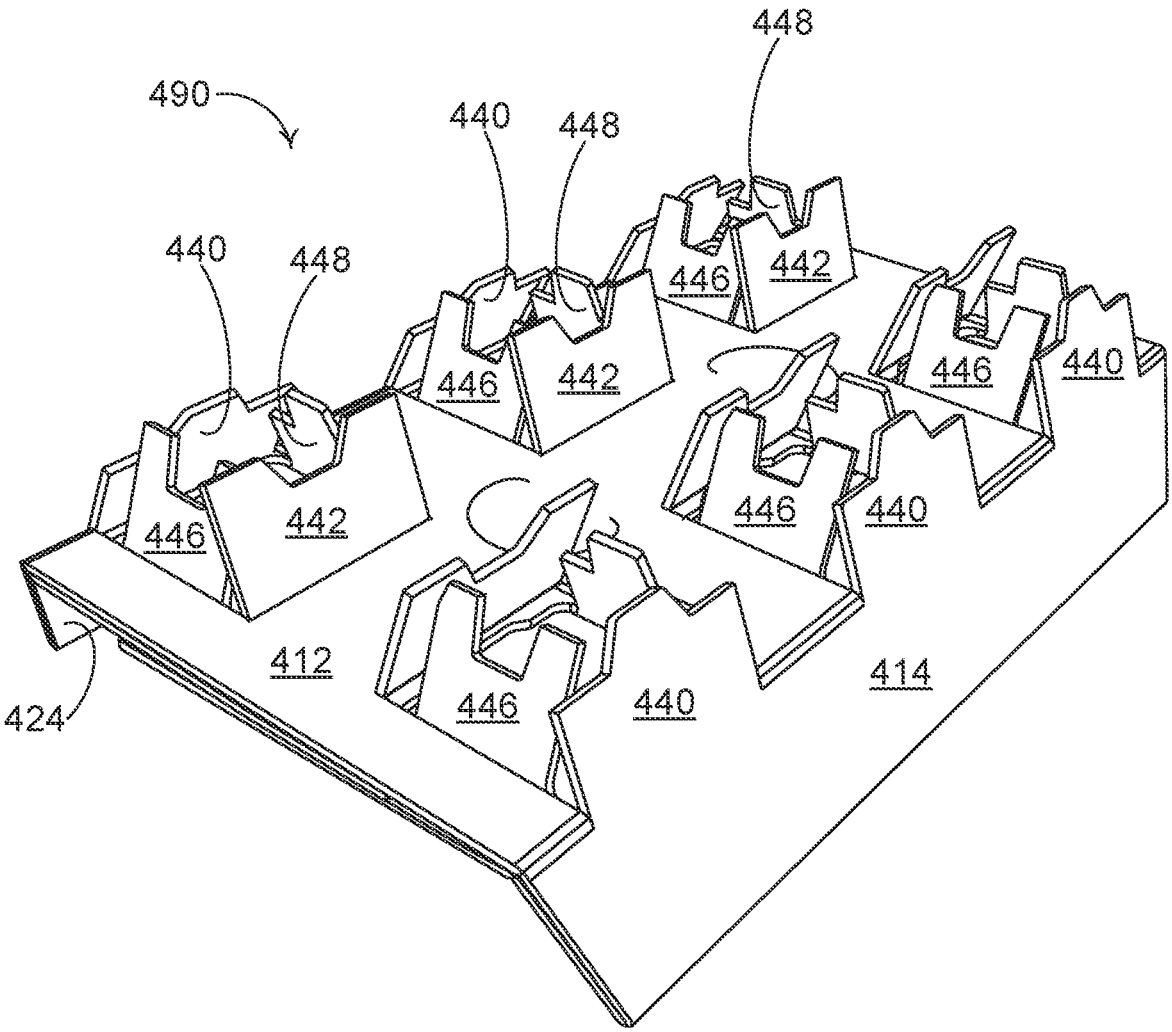
FIG. 9 is a perspective view from above of a carrier formed from the blank of FIG. 7.
Figure 10:
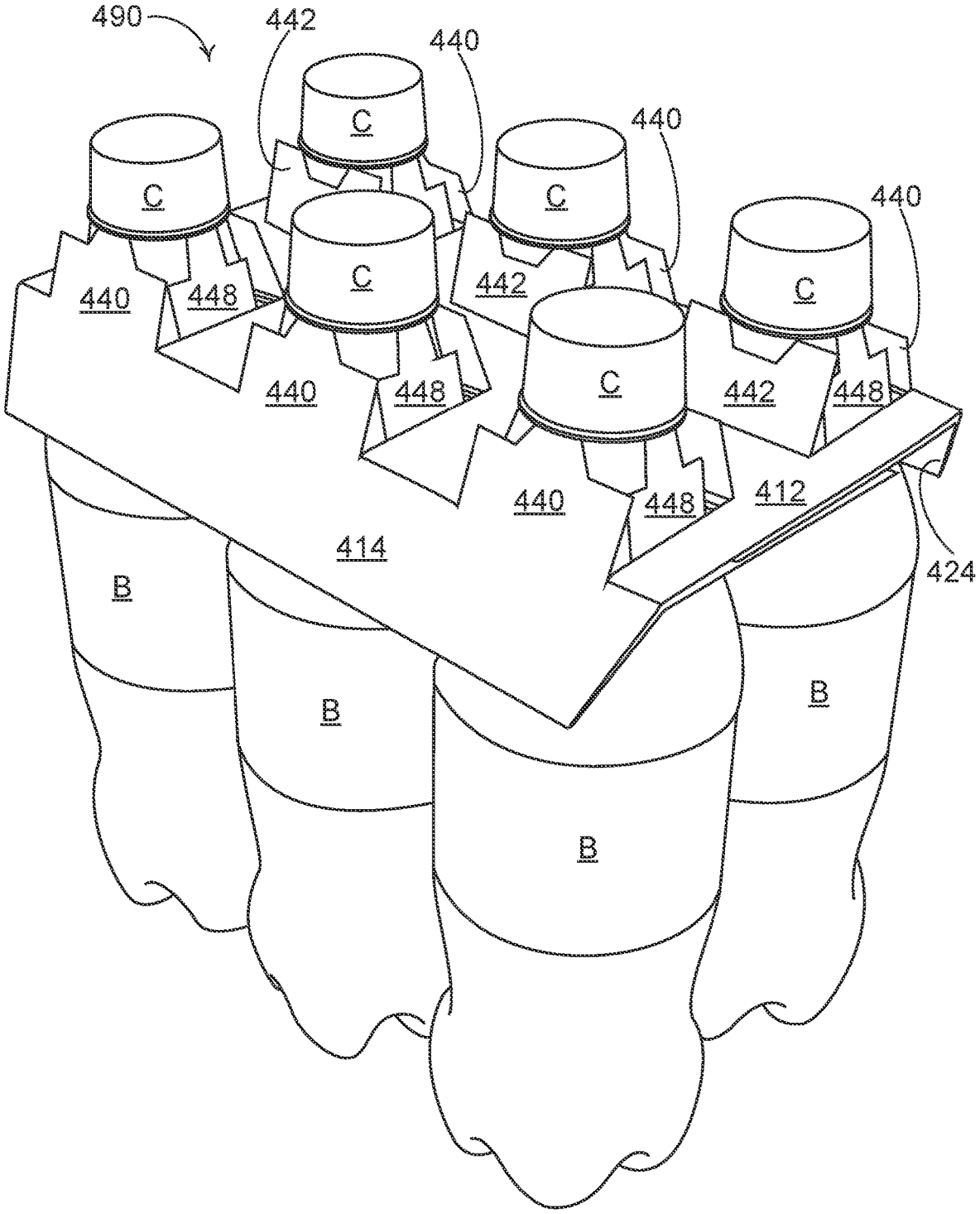
FIG. 10 is a perspective view from above of a package formed from the blank of FIG. 7.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B, as shown in FIG. 2. The articles B may be generally cylindrical; the articles B may comprise a circular cross-sectional shape, at least about a region of engagement with the carrier 90. The blank 10 forms a secondary package for packaging at least one primary product container or package. Alternative blanks 110; 210; 310; 410 are shown in FIGS. 3, 4, 6, and 7 for forming alternative cartons or carriers 290; 490, as shown in FIGS. 5, 9, and 10.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10; 110; 210; 310; 410 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210; 310; 410 are configured to form a carton or carrier 90; 290; 490 for packaging an exemplary arrangement of exemplary articles B. In the illustrated embodiments, the arrangement is a 2×3 matrix or array-two rows of three articles B are provided—and the articles B are bottles, the illustrated bottles are formed from plastic and have a petaloid base, in other embodiments other suitable materials may be utilised such as, but not limited to, glass or metal (e.g., aluminium) and alternative base designs may be employed such as, but not limited to, flat or champagne bottoms. Alternatively, the blanks 10; 110; 210; 310; 410 can be configured to form a carrier for packaging other types, number and size of articles and/or for packaging articles in a different arrangement or configuration.

FIG. 1 shows a blank 10 comprising a plurality of main panels 12, 14A, 14B, 16A, 16B, 18, 20 including a first main panel 12 for forming a top wall or engaging panel 12 of a carrier 90 (see FIG. 2).

The first main panel 12 comprises at least one article retention structure RT. The main panel 12 comprises a plurality of article retention structures RT, specifically six article retention structures RT arranged in 2×3 matrix or array. The main panel 12 comprises three rows of article retention structures RT, each row comprises two article retention structures RT. Each of the article retention structures RT forms an opening for receiving a portion of an article B.

Figure 1B:
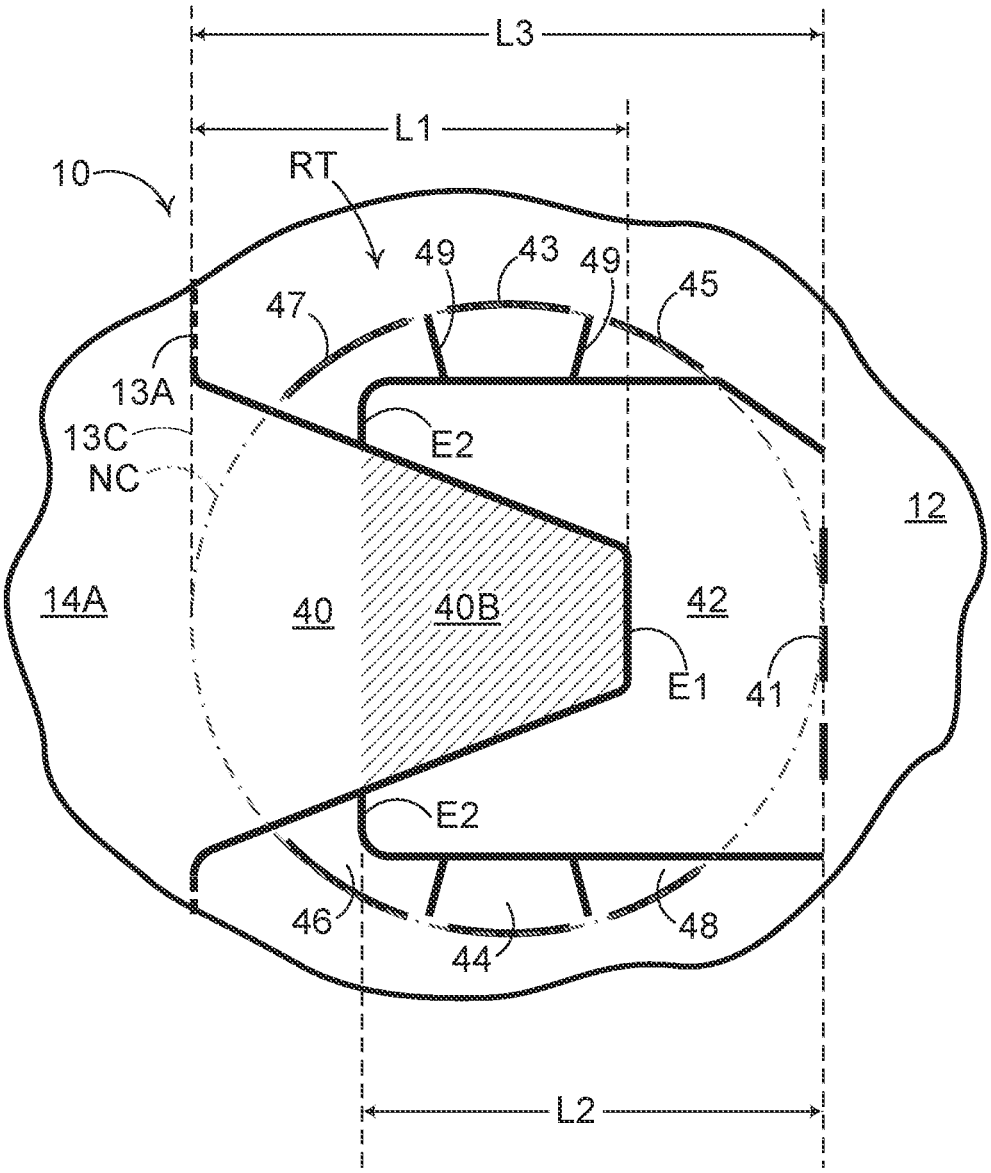
FIG. 1B is an enlarged perspective view from above of a portion of the blank of FIG. 1.

The article retention structures RT comprise an opening for receiving an article B. The opening is defined at least in part by pair of major tabs 40, 42, best shown in FIG. 1B, which engage an article B received in the article retention structure RT. Each of the article retention structures RT is substantially similar in construction and will therefore be described in detail with reference to an article retention structure RT located adjacent to a first side of the blank 10 as shown in FIG. 1B.

A first major tab 40 is struck from the second major tab 42, that is to say the first major tab 40 is formed from material which would otherwise form part of the second major tab 42. The first major tab 40 may be integral or unitary with one of the first and second upper side panels 14A, 16A. The first major tab 40 may extend from said one of the first and second upper side panels 14A, 16A and remain generally coplanar therewith in a set-up condition, that is to say first major tab 40 may not fold with respect to said one of the first and second upper side panels 14A, 16A about a crease or predefined fold line. The second major tab 42 is hingedly connected to the main panel 12 by a fold line 41 defining a hinged edge.

The second major tab 42 is diagonally or diametrically opposite to the first major tab 40.

The first major tab 40 comprises a first engaging edge E1 for engaging an article B.

The second major tab 42 comprises second engaging edge E2 for engaging an article B. The second engaging edge E2 opposes a hinged edge defined by the fold line 41. The hinged edge defines a base or proximal end of the second major tab 42.

The first major tab 40 comprises a first, height or length, dimension L1 defined between the first engaging edge E1 and the fold line 13A. The fold line 13A or a notional co-linear extension 13C thereof defines a base or proximal end of the first major tab 40.

The second major tab 42 comprises a second, height or length, dimension L2 defined between the second engaging edge E2 and the fold line 41. The second dimension L2 may be greater than the first dimension L1 (L2>L1).

The fold line 41 is disposed a third linear dimension L3 from the fold line 13A. Each of the first and second dimensions L1, L2 is greater than one half of the third dimension L3:

$$L1 > L3/2 \text{ and } L2 > L3/2$$

The first engaging edge E1 is disposed between the second engaging edge E2 and the hinged edge, fold line 41, of the second major tab 42.

The second engaging edge E2 is disposed between the first engaging edge E1 of one of the first major tabs 40 and the first or second upper side panels 14A, 16A to which said first major tab 40 is hinged.

The first major tab 40 interrupts the second engaging edge E2 and defines a recess or notch in the second major tab 42. In this way the second engaging edge E2 is disposed about opposing side edges of the first major tab 40.

Figure 2B:
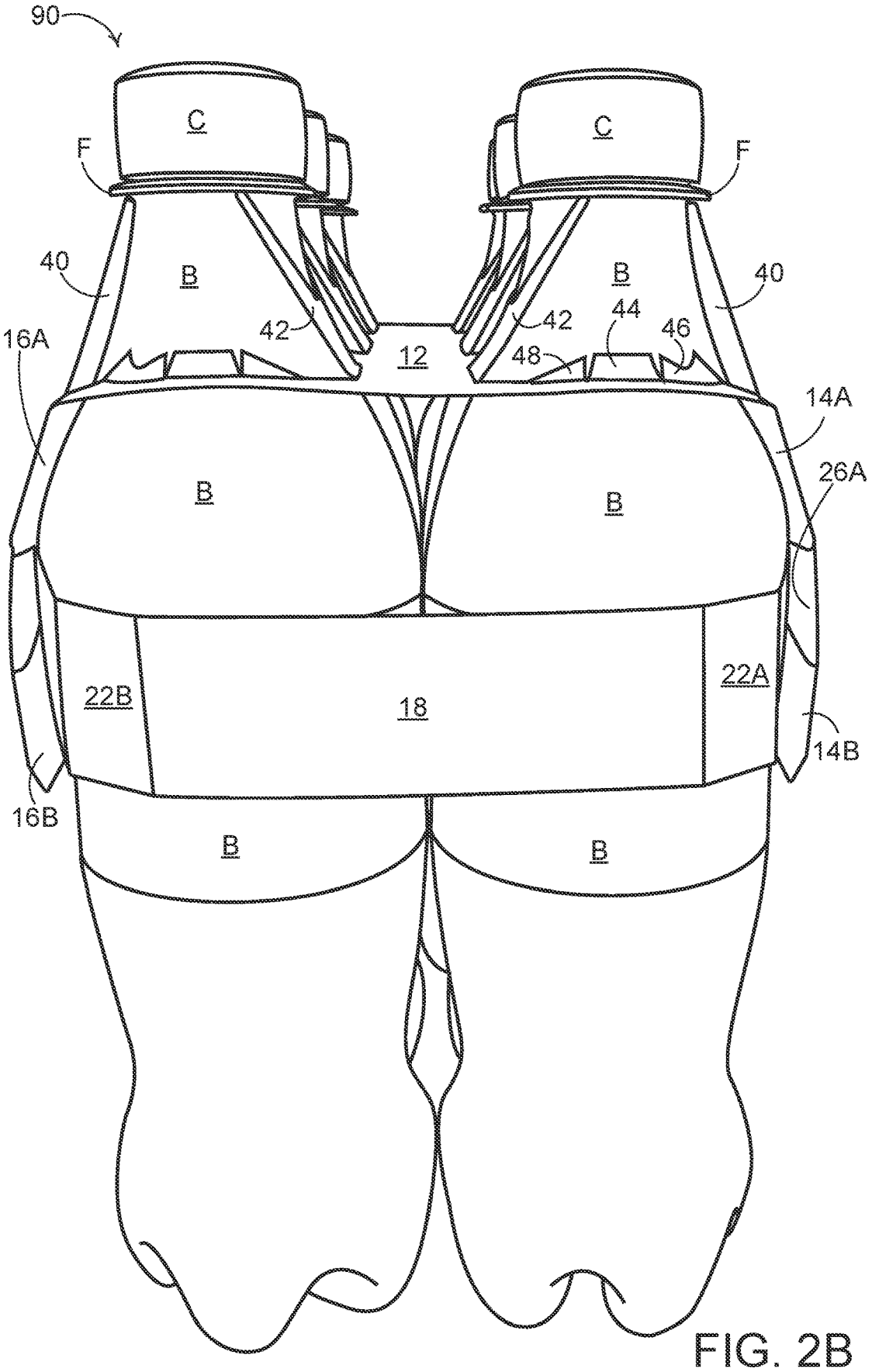
FIG. 2B is a perspective view of an end of a carrier formed from the blank of FIG. 1.

The recess in the second major tab 42 may be configured to receive a portion of the article B, specifically, but not limited to, a neck portion, best illustrated in FIG. 2B. The recess in the second major tab 42 comprises a pair of opposed side edges which may engage with the article B, this may improve stability of the article B in the carrier 90.

At least a portion of the first major tab 40 is narrower in width than the second major tab 42, the first major tab 40 may be tapered in shape so as to reduce in width towards the first engaging edge E1.

The article retention structures RT may comprise at least one minor tab 44, 46, 48. The illustrated embodiment comprises a plurality of minor tabs 44, 46, 48, specifically, but not limited to, six minor tabs 44, 46, 48.

A first set of three minor tabs 44, 46, 48 are disposed on a first side of the major tabs 40, 42, A second set of three minor tabs 44, 46, 48 are disposed on a second side of the major tabs 40, 42. The minor tabs 44, 46, 48 are hingedly connected to the main panel by a hinged connection, the hinged connection may be defined by a plurality of cut lines 43, 45, 47. The plurality of cut lines 43, 45, 47 may defined or lie upon a notional circle NC indicated in FIG. 1B as a phantom (dot-dash) line. The minor tabs 44, 46, 48 are separated from each other by radial cutlines 49. The second major tab 42 may define free end edge of the minor tabs 44, 46, 48, that is to say the second major tab 42 and the minor tabs 44, 46, 48 share a common cut line.

The second major tab 42 may interrupt a free end edge of a first minor tab 46 (the free end edge opposing a hinged edge defined at least in part by cut line 47), so as to define a recessed or notched free end edge. The first major tab 40 may define a free side edge of the first minor tab 46, the first major tab 40 and the first minor tab 46 share a common cut line. The first minor tab 46 and a second minor tab 44 share a common cut line 49, cut line 49 defining a second side edge of the first minor tab 46 and a first side edge of the second minor tab 44. The second minor tab 44 and a third minor tab 48 share a common cut line 49 cut line 49 defining a second side edge of the second minor tab 44 and a first free edge of the third minor tab 48. A second free edge of the third minor tab 48 is defined by a shared cut line between the third minor tab 48 and the second major tab 42, the third minor tab 48 may be generally triangular in shape.

A second main panel 18 forms a first end panel 18 and is connected to a first end of the first main panel 12 by a severable connection in the form of a frangible line 17.

A third main panel 20 forms a second end panel 20 and is connected to a second, opposing, end of the first main panel 12 by a severable connection in the form of a frangible line 19.

A fourth main panel 14A forms a first upper side panel 14A and is hingedly connected to a first side of the first main panel 12 by a hinged connection in the form of a fold line 13A.

A fifth main panel 16A forms a second side panel 16A and is hingedly connected to a second, opposing, side of the first main panel 12 by a hinged connection in the form of a fold line 15A.

A sixth main panel 14B forms a first lower side panel 14B and is hingedly connected to the first upper side panel 14A by a hinged connection in the form of a fold line 13B. The first lower side panel 14B and first upper side panel 14A together form a first side panel 14A/14B.

A seventh main panel 16B forms a second lower side panel 16B and is hingedly connected to the second upper side panel 16A by a hinged connection in the form of a fold line 15B. The second lower side panel 16B and second upper side panel 16A together form a second side panel 16A/16B.

In alternative embodiments the fold lines 13B, 15B may be omitted in such embodiments the first and second side panels 14A/14B, 16A/16B may be substantially planar or may bend or deform about sides of a group of articles B.

The blank 10 comprises a first end structure. The first end structure comprises the first end panel 18. The first end structure comprises a first corner panel 22A hingedly connected to a first end of the first end panel 18 by a hinged connection in the form of a fold line 21A. A second corner panel 22B is hingedly connected to a second, opposing, end of the first end panel 18 by a hinged connection in the form of a fold line 21B.

The first end structure comprises a first securing panel 24A hingedly connected to the first corner panel 22A by a hinged connection in the form of a fold line 23A.

The first end structure comprises a second securing panel 24B hingedly connected to the second corner panel 22B by a hinged connection in the form of a fold line 23B.

The first end structure comprises a first web panel 26A hingedly connected at one end to the first securing panel 24A by a hinged connection in the form of a fold line 25A and hingedly connected at a second end to the first lower side panel 14B by a hinged connection in the form of a fold line 27A.

A second web panel 26B is hingedly connected at one end to the second securing panel 24B by a hinged connection in the form of a fold line 25B and is hingedly connected at a second end to the second lower side panel 16B by a hinged connection in the form of a fold line 27B.

The blank 10 comprises a second end structure. The second end structure comprises the second end panel 20. The second end structure comprises a third corner panel 28A hingedly connected to a first end of the second end panel 20 by a hinged connection in the form of a fold line 29A. A fourth corner panel 28B is hingedly connected to a second, opposing, end of the second end panel 20 by a hinged connection in the form of a fold line 29B.

The second end structure comprises a third securing panel 30A hingedly connected to the third corner panel 28A by a hinged connection in the form of a fold line 31A.

The second end structure comprises a fourth securing panel 30B hingedly connected to the fourth corner panel 28B by a hinged connection in the form of a fold line 31B.

The second end structure comprises a third web panel 32A hingedly connected at one end to the third securing panel 30A by a hinged connection in the form of a fold line 33A and hingedly connected at a second end to the first lower side panel 14B by a hinged connection in the form of a fold line 35A.

A fourth web panel 32B is hingedly connected at one end to the fourth securing panel 30B by a hinged connection in the form of a fold line 33B and is hingedly connected at a second end to the second lower side panel 16B by a hinged connection in the form of a fold line 35B.

It will be appreciated that the first end panel 18, the first corner panel 22A, first securing panel 24A, second corner panel 22B, and the second securing panel 24B, form a first strap 24A/22A/18/22B/24B along a first end of the main panel 12. The second end panel 20, the third corner panel 28A, third securing panel 30A, fourth corner panel 28B, and the fourth securing panel 30B form a second strap 30A/28A/20/28B/30B along a second end of the main panel 12.

In a setup carrier 90 the first strap 24A/22A/18/22B/24B, second strap 30A/28A/20/28B/30B, first lower side panel 14B, second lower side panel 16B form a restraining band about the group of articles B for retaining the group in a closely packed configuration to inhibit separation, flaring or spreading of the articles B.

The end structures of the blank 10 are folded to secure the first and second end panels 18, 20 about sides of a group of articles B. The blank 10 can be applied to the group of articles B in a flat form and folded thereabout.

The main panel 12 is lowered with respect to a group of articles B. The first and second end panels 18, 20 are folded about the opposing sides of the group of articles B. The corner panels 22A, 22B, 28A, 28B are folded about the corners of the group of articles B. The securing panels 24A, 24B, 30, 30 are folded about sides of the group of articles B.

The first and second side panels 14A/14B, 16A/16B are folded downwards about a respective side of the group of articles B to be brought into face contacting relationship with a portion of the securing panels 24A, 24B, 30, 30 and secured thereto by adhesive. The web panels 26A, 26B, 32A, 32B are folded between one of the first and second side panels 14A/14B, 16A/16B and the respective securing panel 24A, 24B, 30, 30 to which they are hingedly connected.

Each upper side panel 14A, 16A may be folded about a fold line 13B, 15B to be nonplanar to the respective lower side panel 14B, 16B to which it is hingedly connected.

The tabs 40, 42, 44, 46, 48 are folded outwardly, upwardly, of the main panel 12. The tabs 40, 42, 44, 46, 48 engage with an article B received in each of the article retention structures RT. The major tabs 40, 42 engage with a flange, projection or undercut of the article B. In some embodiments the major tabs 40, 42 may engage with an end closure C of the article B.

The first major tabs 40 form outer tabs and are substantially coplanar with the upper side panel 14A, 16A from which they extend.

Referring now to FIGS. 3 to 10 there is shown alternative blanks for use in the packaging system of the present disclosure. In the illustrated embodiments, like numerals have, where possible, been used to denote like parts, albeit with the addition of the prefix "100"; "200"; "300"; "400" to indicate that these features belong to the second, third, fourth and fifth embodiments respectively. The alternative embodiments share many common features with the embodiment of FIGS. 1, 1B, and 2, therefore only the differences from the embodiment illustrated in FIGS. 1, 1B, and 2 will be described in any greater detail.

Figure 3:
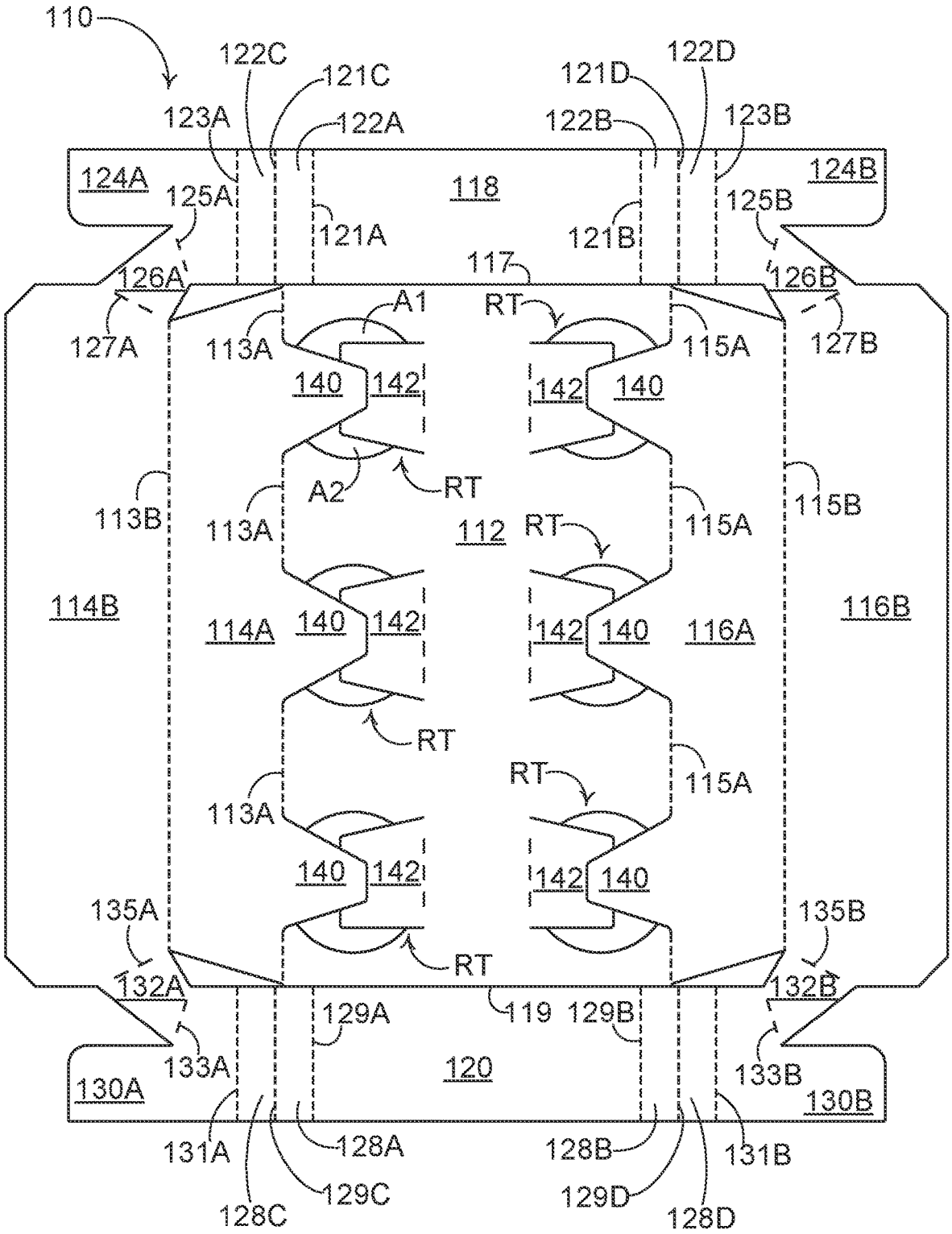
FIG. 3 is a plan view from above of a blank for forming a carrier according to another embodiment of the present disclosure.

Referring now to FIG. 3 there is shown a blank 110 according to a second embodiment of the disclosure. The blank 110 comprises a plurality of main panels 112, 114A, 114B, 116A, 116B, 118, 120 including a first main panel 112 for forming a top wall or engaging panel 112 of a carrier (not shown).

The blank 110 is substantially similar in construction to the blank 10 of FIG. 1 albeit the end structures each comprises two pairs of corner panels 122A-122C, 122B-122D, 128A-128C, 128B-128D. The corner panels 122A, 122C, 122B, 122D, 128A, 128C, 128B, 128D of each pair of corner panels 122A-122C, 122B-122D, 128A-128C, 128B-128D are hingedly connected to each other by a hinged connection in the form of a fold line 122C, 122D, 128C, 128D.

The main panel 112 of the blank 110 includes at least one article retention structure RT. The main panel 112 comprises a plurality of article retention structures RT, specifically six article retention structures RT arranged in 2×3 matrix or array. The article retention structures RT are substantially similar to those shown in FIG. 1 albeit the minor tabs 44, 46, 48 have been omitted and replaced with apertures A1, A2.

Figure 4:
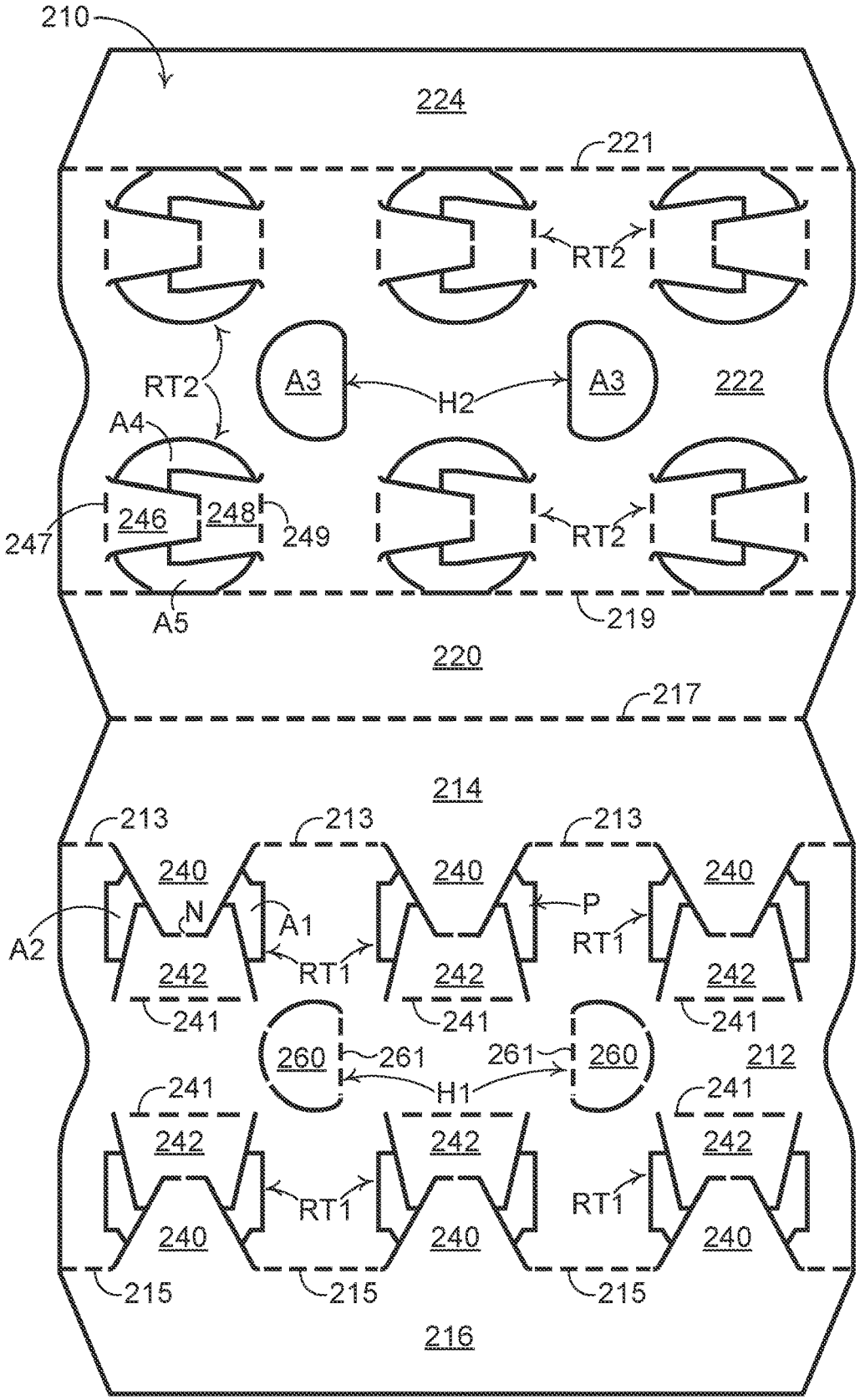
FIG. 4 is a plan view from above of a blank for forming a carrier according to a further embodiment of the present disclosure.
Figure 5:
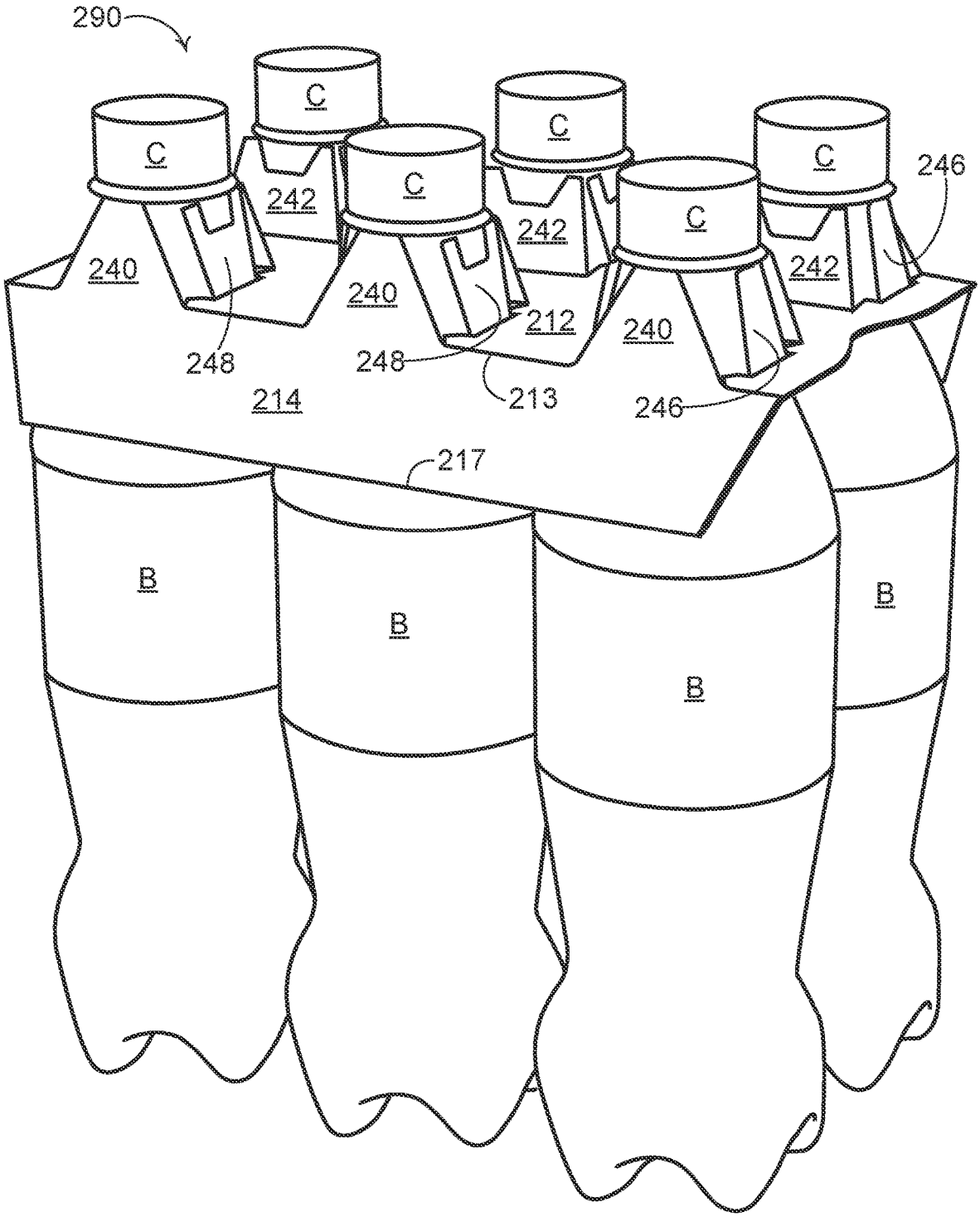
FIG. 5 is a perspective view from above of a carrier formed from the blank of FIG. 4.

Referring now to FIG. 4 there is shown a blank 210 according to a third embodiment of the disclosure. The blank 210 comprises a plurality of main panels 212, 214, 216, 220, 222, 224 including a first primary panel 212 for forming an upper, or outer, top wall or engaging panel 212 and a second primary panel 222 for forming a lower, or inner, top wall or engaging panel 222 of a carrier 290 (see FIG. 5).

The blank 210 comprises a first outer side panel 214 hingedly connected to a first side edge of the first primary panel 212 by a hinged connection in the form of a fold line 213. The blank 210 comprises a second outer side panel 216 hingedly connected to a second, opposing, side edge of the first primary panel 212 by a hinged connection in the form of a fold line 215.

The blank 210 comprises a first inner side panel 220 hingedly connected to a first side edge of the second primary panel 222 by a hinged connection in the form of a fold line 219. The blank 210 comprises a second inner side panel 224 hingedly connected to a second, opposing, side edge of the second primary panel 222 by a hinged connection in the form of a fold line 221.

The first outer side panel 214 is hingedly connected to the first inner side panel 220 by a hinged connection in the form of a fold line 217. Fold line 217 defines a lower edge of the first outer side panel 214 and the first inner side panel 220 in a setup carton 290.

The blank 210 comprises article retention structures RT1, RT2 provided in the first and second primary panels 212, 222.

The first primary panel 212 comprises first article retention structures RT1 substantially similar to the article retention structures RT of FIGS. 1 and 3, albeit a first transverse major tab 240 is frangibly connected to a second transverse major tab 242 by a frangible connection N in the form a connecting nick or bridge. The first article retention structures RT1 comprise a first opening for receiving an article B.

The second primary panel 222 comprises second article retention structures RT2 having a second opening for receiving an article B. The second opening is arranged to be disposed in vertical registry with the first opening in a setup carrier 290. The second opening is defined at least in part by pair of longitudinal major tabs 246, 248. A first longitudinal major tab 246 is struck from the second longitudinal major tab 248, that is to say the first longitudinal major tab 246 is formed from material which would otherwise form part of the second longitudinal major tab 248. The first longitudinal major tab 246 is hingedly connected to the second primary panel 222 by a fold line 247 defining a hinged edge or proximal end. The second longitudinal major tab 248 is hingedly connected to the second primary panel 222 by a fold line 249 defining a hinged edge or proximal end. The fold lines 247, 249 are perpendicularly oriented with respect to the fold line 241 of the second transverse major tab 242.

The first longitudinal major tab 246 may be frangibly connected to a second longitudinal major tab 248 by a frangible connection in the form a connecting nick or bridge.

The first longitudinal major tab 246 and the second longitudinal major tab 248 each comprise an engaging edge for engaging an article B. The engaging edges of the first and second longitudinal major tabs 246, 248 are arranged substantially similarly to those of the first article retention structures RT1 albeit orthogonally oriented thereto.

Each of the second article retention structures RT2 may comprise or be defined, in part, by a first aperture A5. The fold lines 219, 221 hinging the first and second inner side panels 220, 224 to the second primary panel and may be interrupted by the aperture A5 of each of the second article retention structures RT2. Each of the second article retention structures RT2 may comprise or be defined, in part, by a second aperture A4 disposed on an opposing side of the first and second longitudinal major tabs 246, 248 to the first aperture A5.

At least a portion of the first longitudinal major tab 246 is narrower in width than the second longitudinal major tab 248, the first longitudinal major tab 246 may be tapered in shape so as to reduce in width towards its engaging edge.

The apertures A1, A2 of the first article retention structures RT1 are configured and arranged to accommodate or receive a respective one of the first and second longitudinal major tabs 246, 248. The apertures A1, A2 of the first article retention structures RT1 may comprise a tab receiving recess P having a pair of opposed edge portions arranged to closely fit about side edges of said respective tab 246, 248. This may improve stability of the first and second longitudinal major tabs 246, 248 and serve as an alignment guide for aligning the first and second longitudinal major tabs 246, 248 with respect to the articles B.

Optionally, the blank 210 comprises a handle structure H1/H2, the first primary panel 212 comprises a first part H1 of the handle structure H1/H2, the second primary panel 222 comprises a second part H2 of the handle structure H1/H2. The first part H1 of the handle structure H1/H2 comprises at least one first handle or finger opening disposed on a longitudinal axis bisecting the first primary panel 212. The illustrated embodiment comprises a pair of first handle or finger openings.

Each first handle opening is provided between a group of four first article retention structures RT1. Each first handle opening is located at the centre of said group of four article retention structures RT1.

Each first handle opening may be defined by a tab 260 hinged to the first primary panel 212 by a hinged connection in the form of a fold line 261.

The second part H2 of the handle structure H1/H2 comprises at least one second handle or finger opening disposed on a longitudinal axis bisecting the second primary panel 222. The illustrated embodiment comprises a pair of second handle or finger openings. Each second handle opening may be defined by an aperture A3.

Each second handle opening is provided between a group of four second article retention structures RT2. Each second handle opening is located at the centre of said group of four article retention structures RT2.

Each second handle opening in the second primary panel 222 is arranged to be disposed in vertical registry with a respective one of the first handle openings in the first primary panel 212. In use the tabs 260 pass through the aperture A3 in the second primary panel 222 to form a cushioning panel when carrying the package.

The blank 210 is formed into a carrier 290, see FIG. 5, by folding the first inner side panel 220 along with the second primary panel 222 and the second inner side panel 224 about the fold line 217, the first inner side panel 220 is brought into face contacting relationship with the first outer side panel 214. The second primary panel 222 is brought into face contacting relationship with the first primary panel 212 and the second inner side panel 224 is brought into face contacting relationship with second outer side panel 216.

Glue or other adhesive treatment may be employed to secure the second inner side panel 224 to the second outer side panel 216.

The blank 210 may then be applied to a group of articles B, an article B is received in each of the article retention structures RT1, RT2. The tabs 242, 246, 248 are folded out of the plane of the primary panel 212, 222 to which they are hinged. The tabs 240 are displaced out of the plane of the first primary panel 212 in doing so the first and second outer side panels 214, 216 are folded about fold lines 213, 215 respectively. The first and second inner side panels 220, 224 are folded about fold lines 219, 221 as the first and second outer side panels 214, 216 are folded.

Figure 6:
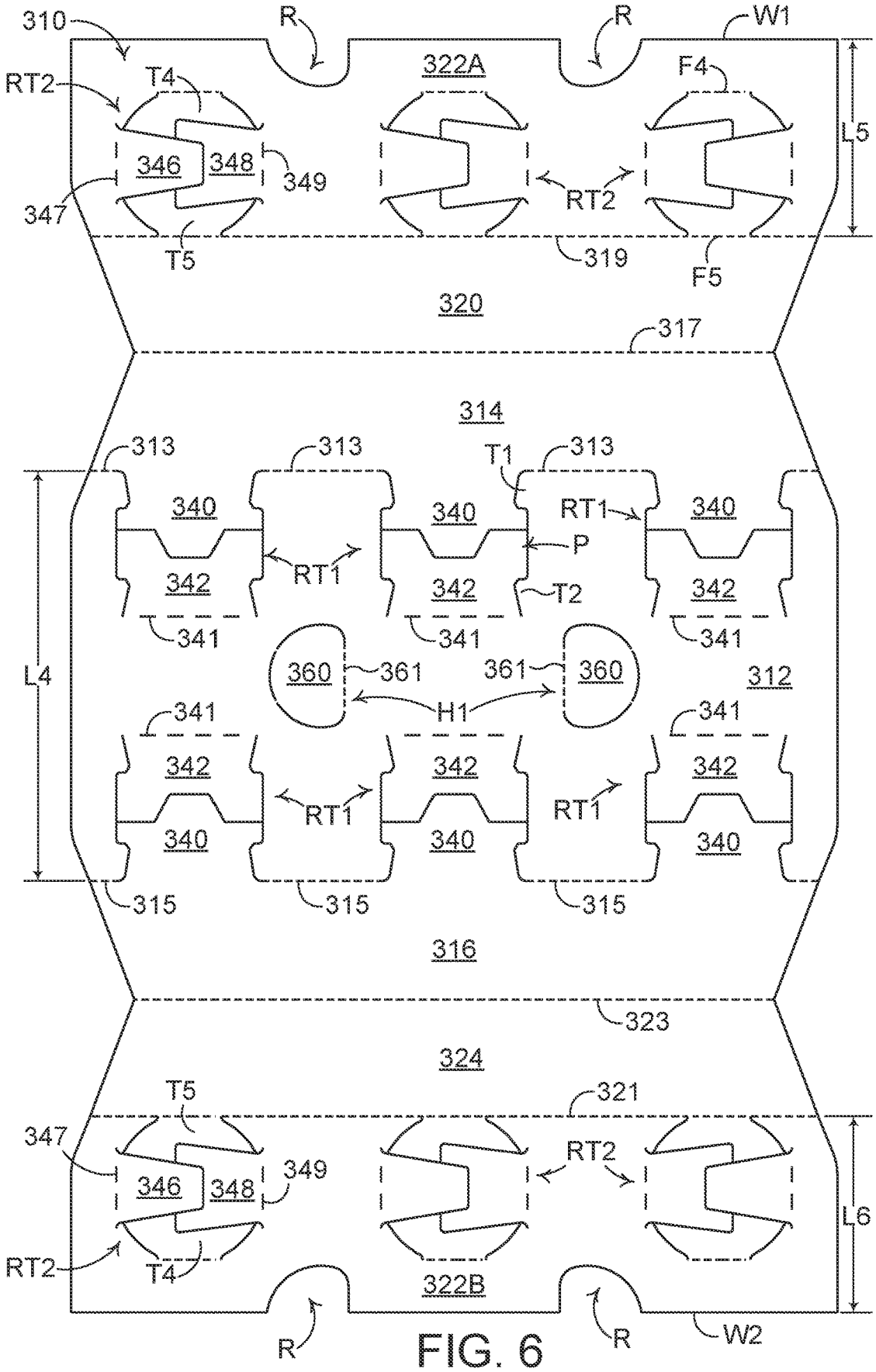
FIG. 6 is a plan view from above of a blank for forming a carrier according to yet another embodiment of the present disclosure.

Referring now to FIG. 6 there is shown a blank 310 according to a fourth embodiment of the disclosure. The blank 310 comprises a plurality of main panels 312, 314, 316, 320, 322A, 322B, 324 including a first primary panel 312 for forming an upper, or outer, top wall or engaging panel 312 and a pair of partial second primary panel 322A, 322B for forming a composite lower, or inner, top wall or engaging panel 322A/322B of a carrier (not shown).

The blank 310 comprises a first outer side panel 314 hingedly connected to a first side edge of the first primary panel 312 by a hinged connection in the form of a fold line 313. The blank 310 comprises a second outer side panel 316 hingedly connected to a second, opposing, side edge of the first primary panel 312 by a hinged connection in the form of a fold line 315.

The blank 310 comprises a first inner side panel 320 hingedly connected to the first outer side panel 314 by a hinged connection in the form of a fold line 317. Fold line 317 defines a lower edge of the first outer side panel 314 and the first inner side panel 320 in a setup carton.

A first partial second primary panel 322A is hingedly connected to the first inner side panel 320 by a hinged connection in the form of a fold line 319.

The blank 310 comprises a second inner side panel 324 hingedly connected to the second outer side panel 316 by a hinged connection in the form of a fold line 323. Fold line 323 defines a lower edge of the second outer side panel 316 and the second inner side panel 324 in a setup carton.

A second partial second primary panel 322B is hingedly connected to the second inner side panel 324 by a hinged connection in the form of a fold line 321.

The blank 310 comprises article retention structures RT1, RT2 provided in the first primary panel 312 and each of the pair of partial second primary panels 322A, 322B.

The first primary panel 312 comprises first article retention structures RT1 substantially similar to the article retention structures of FIGS. 1, 3 and 4, albeit the apertures A1, A2 have been omitted. A tab receiving recess P is defined in the first primary panel 312 in part by a first transverse major tab 240 and in part by a second transverse major tab 242, this avoids the requirement to remove material from the blank 310 to form the apertures A1, A2. The first article retention structures RT1 comprise a first opening for receiving an article B.

Each of the pair of partial second primary panels 322A, 322B comprises second article retention structures RT2. The second article retention structures RT2 define a second opening for receiving an article B. The second opening of each second article retention structures RT2 is arranged to be disposed in vertical registry with the first opening of a respective first article retention structure RT1 in a setup carrier.

The second article retention structures RT2 are substantially similar in construction to the second article retention structures RT2 of FIG. 4 albeit the first and second apertures A5, A4 have been replaced with tabs T5, T4 respectively. abutment/stabilizing tabs which function similarly to the tabs 44, 46, 48 in FIG. 1. The tabs T4, T5 are brought into face-contacting arrangement with inside surfaces of the engaging tabs 342, 340 respectively in a set-up carrier. The tabs T4, T5 reinforce the engaging tabs 342, 340 respectively. Each of the tabs T4, T5 is hinged to one of the pair of partial second primary panels 322A, 322B by a fold line F1, F2. Fold line F5 may be collinear with one of the fold lines 319, 321 hinging the respective one of the pair of partial second primary panels 322A, 322B to an inner side panel 320, 324.

The tab receiving recesses P in the first primary panel 312 are configured and arranged to accommodate or receive a respective one of the first and second longitudinal major tabs 346, 348. The tab receiving recesses P in the first primary panel 312 may comprises a pair of opposed edge portions arranged to closely fit about side edges of said respective tab 346, 348.

Optionally, the blank 310 comprises a handle structure H1/R, the first primary panel 312 comprises a first part H1 of the handle structure H1/R, each of the pair of partial second primary panels 322A, 322B comprises a second part R of the handle structure H1/R. The first part H1 of the handle structure H1/R comprises at least one first handle or finger opening disposed on a longitudinal axis bisecting the first primary panel 312. The illustrated embodiment comprises a pair of first handle or finger openings.

Each first handle opening is provided between a group of four first article retention structures RT1. Each first handle opening is located at the centre of said group of four article retention structures RT1.

Each first handle opening may be defined by a tab 360 hinged to the first primary panel 312 by a hinged connection in the form of a fold line 361.

The second part R of the handle structure H1/R comprises at least one handle or finger recess R struck from a side edge of each of the pair of partial second primary panels 322A, 322B. The illustrated embodiment comprises a pair of handle or finger recesses R struck from each of the pair of partial second primary panels 322A, 322B. The at least one finger recess R of the first partial primary panel 322A and the at least one finger recess R of the second partial primary panel 322B cooperate to form a second handle opening in the composite engaging panel 322A/322B of a carrier.

Each of the second handle openings in the composite engaging panel 322A/322B is arranged to be disposed in vertical registry with a respective one of the first handle openings in the first primary panel 312. In use each tab 360 pass through a respective one of the second handle openings in the composite engaging panel 322A/322B defined by a pair of recesses R.

The blank 310 is formed into a carrier, by folding the first inner side panel 320 along with the first partial primary panel 322A about the fold line 317, the first inner side panel 320 is brought into face contacting relationship with the first outer side panel 314. The first partial primary panel 322A is brought into face contacting relationship with a first portion of the first primary panel 312. The second inner side panel 324 along with the second partial primary panel 322B is folded about the fold line 323, the second inner side panel 324 is brought into face contacting relationship with the second outer side panel 316. The second partial primary panel 322B is brought into face contacting relationship with a second or remaining portion of the first primary panel 312.

Glue or other adhesive treatment may be employed to secure the first and second inner side panels 320, 324 to the first and second outer side panels 314, 316.

The first primary panel 312 comprises a first width dimension L4.

The first and second first partial primary panels 322A, 322B may be dimensioned such that side edge W1, W2 are spaced apart from each other. The first and second first partial primary panels 322A, 322B comprise a second and third width dimension L5, L6 respectively, the second width dimension L5 may be equal to the third width dimension L6, L5=L6. The sum of the second and third width dimensions L5, L6 may be less than the first width dimension L4, L5+L6<L4.

The blank 310 is then applied to a group of articles B in a similar manner to that described above in relation to the blank 210 of FIG. 4. When the inner and outer side panels 320, 324, 314, 316 are folded with respect the primary panels 312, 322A, 322B the first and second first partial primary panels 322A, 322B may move with respect to the first primary panel 312. A side edge W1 of the first partial primary panel 322A may move towards a side edge W2 of the second partial primary panel 322B. In some embodiment the side edge W1 of the first partial primary panel 322A and the side edge W2 of the second partial primary panel 322B may be brought into abutment.

Figure 7:
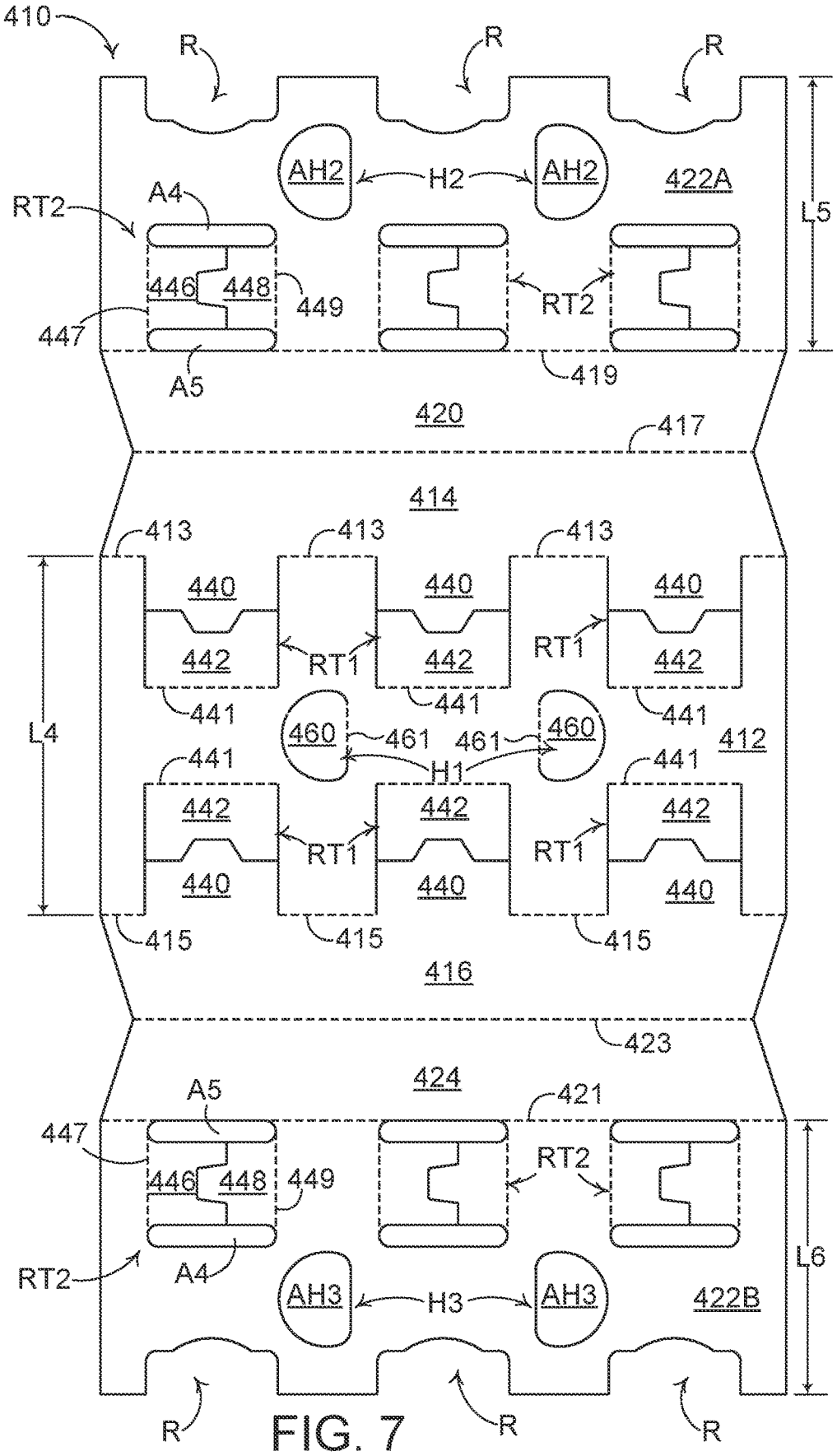
FIG. 7 is a plan view from above of a blank for forming a carrier according to yet a further embodiment of the present disclosure.

Referring now to FIG. 7 there is shown a blank 410 according to a fifth embodiment of the disclosure. The blank 410 comprises a plurality of main panels 412, 414, 416, 420, 422A, 422B, 424 including a first primary panel 412 for forming an upper, or outer, top wall or engaging panel 412 and a pair of partial second primary panel 422A, 422B for forming an overlapping composite lower, or inner, top wall or engaging panel 422A/422B of a carrier 490 (see FIGS. 9 and 10).

The blank 410 comprises a first outer side panel 414 hingedly connected to a first side edge of the first primary panel 412 by a hinged connection in the form of a fold line 413. The blank 410 comprises a second outer side panel 416 hingedly connected to a second, opposing, side edge of the first primary panel 412 by a hinged connection in the form of a fold line 415.

The blank 410 comprises a first inner side panel 420 hingedly connected to the first outer side panel 414 by a hinged connection in the form of a fold line 417. Fold line 417 defines a lower edge of the first outer side panel 414 and the first inner side panel 420 in a setup carton 490.

A first partial second primary panel 422A is hingedly connected to the first inner side panel 420 by a hinged connection in the form of a fold line 419.

The blank 410 comprises a second inner side panel 424 hingedly connected to the second outer side panel 416 by a hinged connection in the form of a fold line 423. Fold line 423 defines a lower edge of the second outer side panel 416 and the second inner side panel 424 in a setup carton.

A second partial second primary panel 422B is hingedly connected to the second inner side panel 424 by a hinged connection in the form of a fold line 421.

The first primary panel 412 comprises a first width dimension L4.

The first and second first partial primary panels 422A, 422B comprise a second and third width dimension L5, L6 respectively, the second width dimension L5 may be equal to the third width dimension L6, L5=L6. The sum of the second and third width dimensions L5, L6 may be greater than the first width dimension L4, L5+L6>L4.

The blank 410 comprises article retention structures RT1, RT2 provided in the first primary panel 412 and each of the pair of partial second primary panels 422A, 422B.

First article retention structures RT1 are provided in the first primary panel 412 and are similar to those of the embodiment shown in FIG. 6 albeit each of the first and second transverse major tabs 440, 442 are generally rectangular in shape, the tab receiving recesses have been omitted. The first article retention structures RT1 comprise a first opening in the first primary panel 412, the first opening may be generally rectangular or square in shape. A portion of the first transverse major tab 440 is struck from the second transverse major tab 442, said portion may be trapezoidal in shape and is medially located between side edges of the first transverse major tab 440. A complementary recess is defined in the second transverse major tab 442.

Second article retention structures RT2 are provided in each of the pair of partial second primary panels 422A, 422B. Each of the second article retention structures RT2 comprises a pair of longitudinal major tabs 446, 448 hingedly connected to one of the first and second partial second primary panels 422A, 422B by a fold line 447, 449 and arranged in opposition to each other Each of the first and second longitudinal major tabs 446, 448 are generally rectangular in shape. A portion of the second longitudinal major tab 448 is struck from the first longitudinal major tab 446, said portion may be trapezoidal in shape and is medially located between side edges of the second longitudinal major tab 448. A complementary recess is defined in the first longitudinal major tab 446.

The second article retention structures RT2 comprise a pair of cutaways in the form of apertures or slots A4, A5. The pair of slots A4, A5 define a respective side edge of the first and second longitudinal major tabs 446, 448.

The pair of slots A4, A5 and the first and second longitudinal major tabs 446, 448 define a second opening in one of the first and second partial second primary panels 422A, 422B. The second opening is substantially similar in shape and dimension to the first opening in the first primary panel 412. The pair of slots A4, A5 have the effect of reducing the width of the first and second longitudinal major tabs 446, 448.

The first partial second primary panel 422A comprises at least one recess R struck from a side edge thereof. The illustrated embodiment comprises a plurality of recesses R, specifically, but not limited to three recesses R. A recess R is provided for each of the first article retention structures RT1 disposed adjacent to the first outer side panel 414.

The second partial second primary panel 422B comprises at least one recess R struck from a side edge thereof. The illustrated embodiment comprises a plurality of recesses R, specifically, but not limited to three recesses R. A recess R is provided for each of the first article retention structures RT1 disposed adjacent to the second outer side panel 416.

The recesses R are arranged to be aligned with one of the first article retention structures RT1. The recesses R comprise an edge S1, a portion of which may be arcuate or curved in shape, the arcuate portion may be complementary to a neck portion of an article B.

An inner one of the slots A4 comprises an inner edge S2, inner edge S2 may be linear in shape. The inner edge S2 defines a side edge of each of the first and second longitudinal major tabs 446, 448.

Figure 8A:
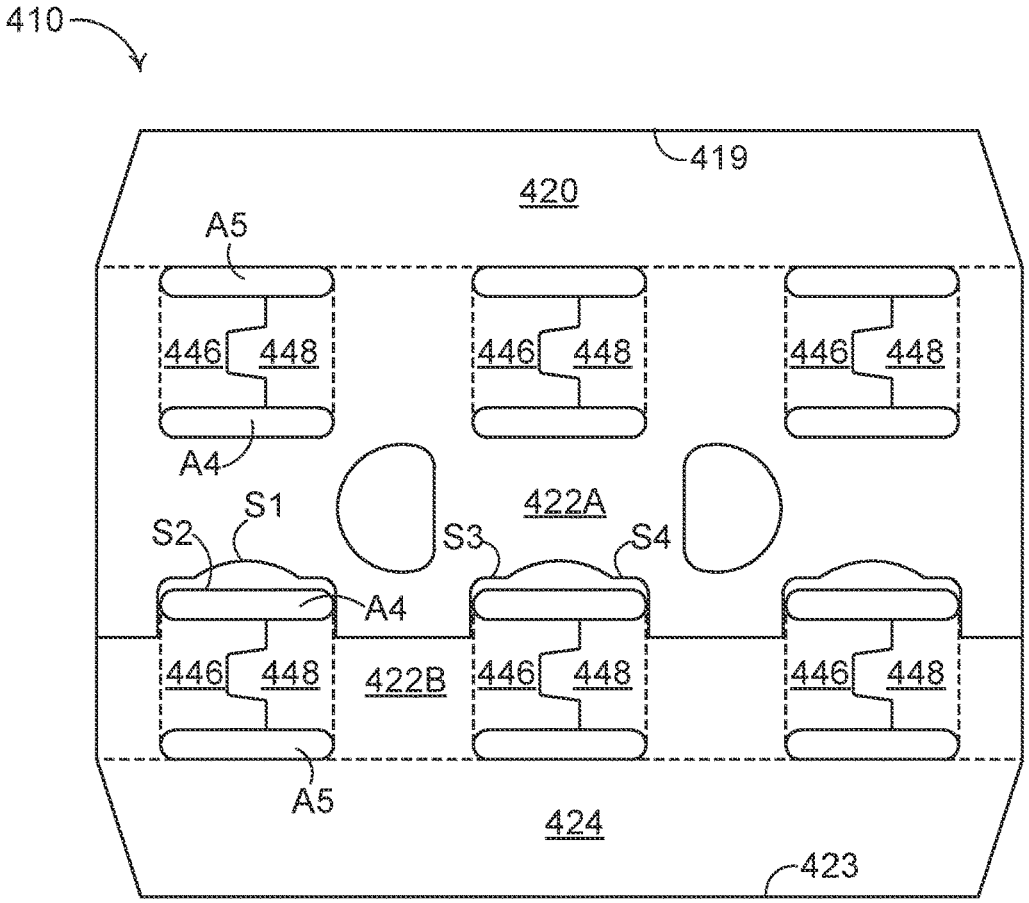
FIGS. 8A and 8B illustrate stages of construction of the blank of FIG. 7 into a carrier.

As shown in FIG. 8A the inner edge S2 is offset or spaced apart from the edge S1 of a recess R, the edge S1 of a recess R is inset with respect to the inner edge S2, that is to say it is disposed in closer proximity to a notional line longitudinally bisecting the first primary panel 412.

Figure 8B:
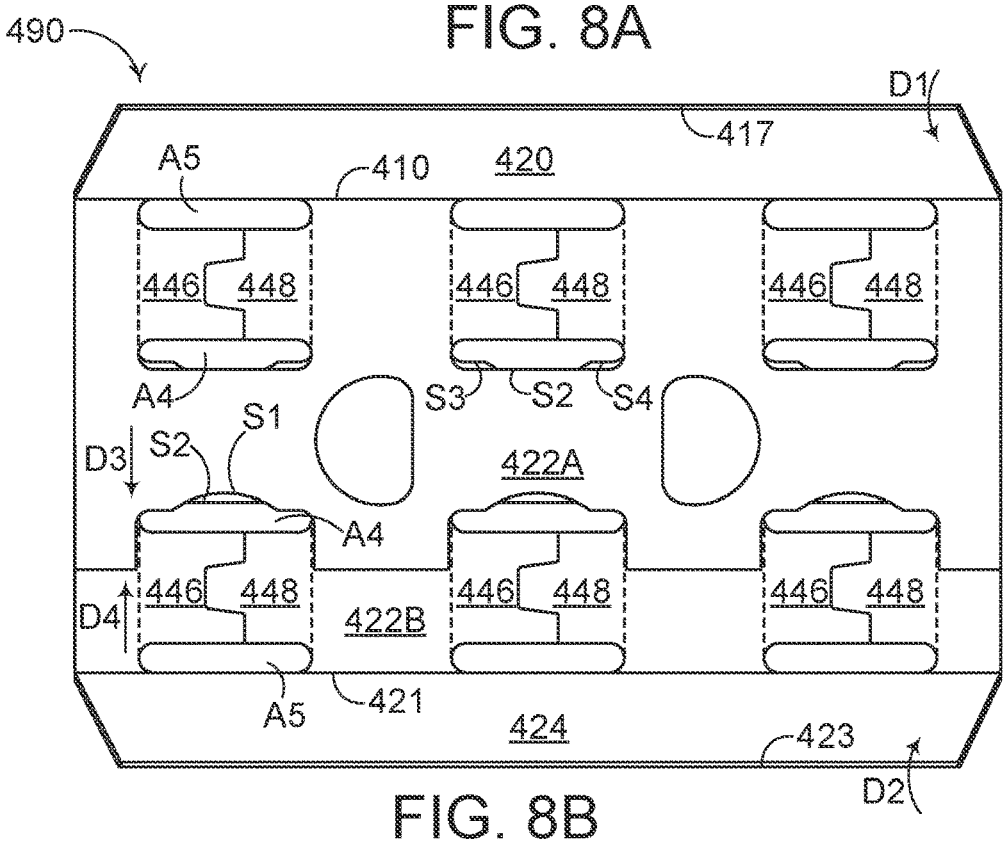

When the inner and outer side panels 420, 424, 414, 416 are folded with respect to the primary panels 412, 422A, 422B, as shown in FIG. 8B, the article receiving opening in the primary panels 412, 422A, 422B is reduced in size, a portion of the first partial second primary panel 422A obscures a portion of a slot A4 in the second partial second primary panel 422B, similarly a portion of the second partial second primary panel 422B obscures a portion of a slot A4 in the first partial second primary panel 422A. Portions S3, S4 of the edge S1 of each recess R define in part the article receiving opening in the primary panels 412, 422A, 422B, in this way the article receiving opening is effectively tightened, or reduced in size, about a portion of the article B received therein.

The slots A4 prevent or reduce the likelihood of interference between the first and second longitudinal major tabs 446, 448 and the primary panel or panels 422B, 412 disposed above. For example, side edges, defined by slot A4, of the first and second longitudinal major tabs 446, 448 provided in the first partial second primary panel 422A are separated from the edges S3, S4 of the second partial second primary panel 422B. The opposing side edges, defined by slot A5, of the first and second longitudinal major tabs 446, 448 provided in the first partial second primary panel 422A are separated or spaced apart from the side walls 420, 414.

Optionally, the blank 410 comprises a handle structure H1/H2/H3, the first primary panel 412 comprises a first part H1 of the handle structure H1/H2/H3, the first partial second primary panel 422A comprises a second part H2 of the handle structure H1/H2/H3, and the second partial second primary panel 422B comprises a third part H3 of the handle structure H1/H2/H3. The first part H1 of the handle structure H1/H2/H3 comprises at least one first handle or finger opening disposed on a longitudinal axis bisecting the first primary panel 412. The illustrated embodiment comprises a pair of first handle or finger openings.

Each first handle opening is provided between a group of four first article retention structures RT1. Each first handle opening is located at the centre of said group of four article retention structures RT1.

Each first handle opening may be defined by a tab 460 hinged to the first primary panel 412 by a hinged connection in the form of a fold line 461.

The second part H2 of the handle structure H1/H2/H3 comprises at least one second handle or finger opening struck from the first partial second primary panel 422A. The illustrated embodiment comprises a pair of second handle or finger openings. Each second handle opening may be defined by a first aperture AH2.

The third part H3 of the handle structure H1/H2/H3 comprises at least one third handle or finger opening struck from the second partial second primary panel 422B. The illustrated embodiment comprises a pair of third handle or finger openings. Each third handle opening may be defined by a second aperture AH3.

Each second handle opening in the first partial second primary panel 422A is arranged to be disposed in vertical registry with a respective one of the first handle openings in the first primary panel 212 and with a respective third handle opening in the second partial second primary panel 422B. In use the tabs 460 pass through the first and second apertures AH2, AH3 in the first and second partial primary panels 422A, 422B to form a cushioning panel when carrying the package.

The blank 410 is formed into a carrier 490, by folding the second inner side panel 424 along with the second partial primary panel 422B about the fold line 423, the second inner side panel 424 is brought into face contacting relationship with the second outer side panel 416. The second partial primary panel 422A is brought into face contacting relationship with a first portion of the first primary panel 412, as shown in FIG. 8A. The first inner side panel 420 along with the first partial primary panel 422A is folded about the fold line 417, the first inner side panel 420 is brought into face contacting relationship with the first outer side panel 414. The first partial primary panel 422A is brought into overlapping relationship with a second portion of the first primary panel 412 and with a portion of the second partial primary panel 422B.

The blank 410 is then applied to a group of articles B, in the process of applying the blank 410 to the group of articles B the inner and outer side walls 420, 424, 414, 416 are folded about sides of the group of articles B.

FIG. 8B illustrates the first and second partial primary panels 422A, 422B relative to the first primary panel 412 when the first inner and outer side panels 420, 414 and the second inner and outer side panels 424, 416 are folded about fold lines 413, 419, 415, 421, as indicated by direction arrows D1, D2, the articles B have been omitted for illustrative purposes. The first partial primary panel 422A is displaced towards the second inner side panel 424, as indicated by direction arrow D3. The second partial primary panel 422B is displaced towards the first inner side panel 420, as indicated by direction arrow D4. The article receiving openings being tightened, about a neck portion of the article B received therein.

The present disclosure provides a carrier 90; 290; 490 of the top engaging type having article retention structures RT; RT1, RT2 for engaging articles B and a blank 10; 110; 210; 310; 410 for forming the article carrier 90; 290; 490.

The present disclosure provides an article carrier 90; 290; 490 having at least one top-engaging device RT; RT1, RT2 which comprises at least a pair of opposing engaging tabs 40, 42; 140, 142; 240, 242, 246, 248; 340, 342, 346, 348; 440, 442, 446, 448 each having a length L1, L2 greater than a half of the distance L3 between their hinged connections 13A, 41; 213, 215, 241, 247, 249; 313, 315, 341, 347, 349; 413, 415, 441, 447, 449 to a primary panel 12; 112; 212, 222; 312, 322A, 322B; 412, 422A, 422B.

The present disclosure provides an article carrier 90; 290; 490 having at least one top-engaging device RT; RT1, RT2 which comprises at least a pair of opposing engaging tabs 40, 42; 140, 142; 240, 242, 246, 248; 340, 342, 346, 348; 440, 442, 446, 448 each having a length L1, L2 greater than a half of the distance L3 between bases or proximal ends of the opposing engaging tabs 40, 42; 140, 142; 240, 242, 246, 248; 340, 342, 346, 348; 440, 442, 446, 448. Each of the pair of opposing engaging tabs 40, 42; 140, 142; 240, 242, 246, 248; 340, 342, 346, 348; 440, 442, 446, 448 is struck from, or defined in, a primary panel 12; 112; 212, 222; 312, 322A, 322B; 412, 422A, 422B. The bases or proximal ends oppose an engaging edge of the engaging tabs 40, 42; 140, 142; 240, 242, 246, 248; 340, 342, 346, 348; 440, 442, 446, 448. The base or proximal end may be defined, at least in part, by a hinged connection 13A, 41; 213, 215, 241, 247, 249; 313, 315, 341, 347, 349; 413, 415, 441, 447, 449 in the primary panel 12; 112; 212, 222; 312, 322A, 322B; 412, 422A, 422B. The hinged connection 41; 241, 247, 249; 341, 347, 349; 441, 447, 449 may couple the engaging tabs 40, 42; 140, 142; 240, 242, 246, 248; 340, 342, 346, 348; 440, 442, 446, 448 to the primary panel 12; 112; 212, 222; 312, 322A, 322B; 412, 422A, 422B. The hinged connection 13A; 213, 215; 313, 315; 413, 415 may couple a secondary panel 14A, 16A; 114A, 116A; 214, 216; 314, 316; 414, 416 to the primary panel 12; 112; 212, 222; 312, 322A, 322B; 412, 422A, 422B.

The present disclosure provides an article carrier 90; 290; 490 having at least one top-engaging device RT; RT1, RT2 which comprises at least first and second engaging tabs 40, 42; 140, 142; 240, 242, 246, 248; 340, 342, 346, 348; 440, 442, 446, 448. The first tab 40; 140; 240, 246; 340, 346; 440, 446 comprises a distal portion 40B formed from the second tab 42; 142; 242, 248; 342, 348; 442, 448 such that the distal portion 40B remains in the plane of the remainder of the first tab 40; 140; 240, 246; 340, 346; 440, 446 when a free end of the distal portion 40B is brought into engagement with an article B.

The first tab 40; 140; 240, 246; 340, 346; 440, 446 may be frangibly connected to the second tab 42; 142; 242, 248; 342, 348; 442, 448, said frangible connection may be provided at the free end of the distal portion 40B.

The present disclosure provides an article carrier 90; 290; 490 having at least one top-engaging device RT; RT1, RT2 which comprises at least first and second engaging tabs 40, 42; 140, 142; 240, 242, 246, 248; 340, 342, 346, 348; 440, 442, 446, 448 wherein the first tab 40; 140; 240, 246; 340, 346; 440, 446 comprises at least a portion 40B formed from a recessed area of the second tab 42; 142; 242, 248; 342, 348; 442, 448 such that the second tab 42; 142; 242, 248; 342, 348; 442, 448 and the free end E1 of the at least a portion 40B of the first tab 40; 140; 240, 246; 340, 346; 440, 446 engage the same article B when the article carrier 90; 290; 490 is in use.

The recessed area of the second tab 42; 142; 242, 248; 342, 348; 442, 448 may be dimensioned to receive a portion of the article B received in the at least one top-engaging device RT; RT1, RT2.

The present disclosure provides an article carrier 90; 290; 490 having at least one top-engaging device RT; RT1, RT2 which comprises at least first and second engaging tabs 40, 42; 140, 142; 240, 242, 246, 248; 340, 342, 346, 348; 440, 442, 446, 448 wherein the first tab 40; 140; 240, 246; 340, 346; 440, 446 comprises at least a portion 40B formed from a recessed area of the second tab 42; 142; 242, 248; 342, 348; 442, 448 wherein the first tab 40; 140; 240, 246; 340, 346; 440, 446 is disposed adjacent to a side panel 14A, 16A; 114A, 116A; 214, 216; 314, 316; 414, 416 which is hinged to a primary panel 12; 112; 212, 222; 312, 322A, 322B; 412, 422A, 422B from which the first tab 40; 140; 240, 246; 340, 346; 440, 446 is struck. The first tab 40; 140; 240, 246; 340, 346; 440, 446 may be connected, hinged to, or integral with the side panel 14A, 16A; 114A, 116A; 214, 216; 314, 316; 414, 416.

The present disclosure provides an article carrier 90; 290; 490 having a first primary panel 212; 312; 412 and a second primary panel 222; 322A, 322B; 422A, 422B each having at least one top-engaging device RT1, RT2 each comprising at least a pair of opposing engaging tabs 240, 242, 246, 248; 340, 342, 346, 348; 440, 442, 446, 448.

The first primary panel 212; 312; 412 comprising at least one first top-engaging device RT1 and the second primary panel 222; 322A, 322B; 422A, 422B having at least one second top-engaging device RT2. The tabs 246, 248; 346, 348; 446, 448 of at least one second top-engaging device RT2 are oriented perpendicularly to the tabs 240, 242; 340, 342; 440, 442 of the at least one first top-engaging device RT1.

The first primary panel 212; 312; 412 may comprise a tab receiving recess P for receiving a respective one of the tabs 246, 248; 346, 348; 446, 448 of the at least one second top-engaging device RT2. The tab receiving recess P may be defined between a pair of lugs or lobes T1, T2.

The tab receiving recess P may be defined in part by a portion of each of the pair of opposing engaging tabs 240, 242; 340, 342; 440, 442 in the first primary panel 212; 312; 412. This may be advantageous since there is no requirement to remove or dispose of scrap or waste material.

The first primary panel 212; 312; 412 may comprise a pair of diametrically opposed tab receiving recesses P, each may be defined in part by a portion of each of the pair of opposing engaging tabs 240, 242; 340, 342; 440, 442 in the first primary panel 212; 312; 412.

The present disclosure provides an article carrier 90; 290; 490 having a first primary panel 212; 312; 412 and a pair of second primary panels 322A, 322B; 422A, 422B each having at least one top-engaging device RT1, RT2 each comprising at least a pair of opposing engaging tabs 240, 242, 246, 248; 340, 342, 346, 348; 440, 442, 446, 448. A first one 422A of the pair of second primary panels 322A, 322B; 422A, 422B may be disposed in at least partial overlapping relationship with a second one 422B of the pair of second primary panels 322A, 322B; 422A, 422B. The overlapping pair of second primary panels 422A, 422B may each provide a ply of a handle structure H2, H3, together with the first primary panel 212; 312; 412 a three-ply handle structure H1, H2, H3 may be provided.

At least one of the pair of second primary panels 322A, 322B; 422A, 422B may comprise a recess R configured to be disposed in registry with at least a portion of an aperture or opening in the first primary panel 312; 412.

The recess R provided in one of the pair of second primary panels 322A, 322B; 422A, 422B may be aligned with an opening of a top-engaging device RT2 in the other of the pair of second primary panels 322A, 322B; 422A, 422B. The recess R may comprise a curved edge portion shaped to accommodate an article B received in the top-engaging device RT2. The recess R may be configured and arranged to allow unencumbered movement of the pair of second primary panels 322A, 322B; 422A, 422B with respect to each other.

The engaging devices RT2 in the pair of second primary panels 422A, 422B may comprise at least one slot, optionally a pair of slots defining side edges of the pair of opposing engaging tabs 446, 448.

The first primary panel 312; 412 comprises a first width dimension L4. The first and second first partial primary panels 322A, 322B; 422A, 422B comprise second and third width dimensions L5, L6 respectively, the second width dimension L5 may be equal to the third width dimension L6. The sum of the second and third width dimensions L5, L6 may be selected to be either less than the first width dimension L4 or greater than the first width dimension L4. The sum of the second and third width dimensions L5, L6 may be not equal to the first width dimension L4.

The blanks 10; 110; 210; 310; 410 include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). Examples of such a substrate are: 24 point (pt.) SBS board (solid bleached sulphate paperboard coated on one side, trade name PrintKote®) or CNK® board (Coated Natural Kraft®—an unbleached kraft paperboard having a clay coating on one side, trade name CarrierKote™); 21 point (pt.) SBS board or CNK® board; and F flute corrugated fiberboard, manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 210; 310; 410 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g., MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

It can be appreciated that various changes may be made within the scope of the present invention. For example, the size and shape of the panels and apertures may be adjusted to accommodate articles of differing size or shape. The shoulder panels may be omitted. The present invention is not limited to cartons of the top-engaging type, the invention may be employed with other carton styles such as, but not limited to, open top crates, lidded or closed top crates.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for packaging at least one article, the carrier comprising a main panel having at least one top-engaging device for engaging an article, the at least one top-engaging device having an article receiving opening and at least a pair of opposing engaging tabs, wherein a first engaging tab of the pair of opposing engaging tabs is hingedly connected to the main panel by a first hinged connection and extends to a first engaging edge, the first engaging tab having a first length defined between the first engaging edge and the first hinged connection, wherein a second engaging tab of the pair of opposing engaging tabs is hingedly connected to the main panel by a second hinged connection and extends to a second engaging edge, the second engaging tab having a second length defined by the second engaging edge and the second hinged connection, wherein each of the first and second lengths is greater than half of the distance between the first and second hinged connections.

2. An article carrier according to claim 1 wherein each of the first and second engaging tabs extends from a proximal end thereof to a respective one of the first and second engaging edges, and wherein each of the first and second lengths is defined between the proximal end thereof and the respective one of the first and second engaging edges.

3. An article carrier according to claim 2, wherein the proximal end of one of the first and second engaging tabs is defined, at least in part, by a respective one of the first and second hinged connections.

4. An article carrier according to claim 2, wherein the proximal end of at least one of the first and second engaging tabs is defined by a notional line which is colinear with a respective one of the first and second hinged connections which couples a secondary panel to the main panel.

5. An article carrier according to claim 2, wherein the first engaging tabs extends from the proximal end thereof to the first engaging edge, and wherein the first engaging tab has no fold line interposed at the proximal end thereof.

6. An article carrier according to claim 1, wherein one of the first and the second hinged connections couples a respective one of the first and second engaging tabs the main panel.

7. An article carrier according to claim 1, wherein the first engaging tab comprises a distal portion formed from the second engaging tab such that the distal portion remains in the plane of the remainder of the first engaging tab when a free end of the distal portion is brought into engagement with the at least one article wherein the first engaging tab is frangibly connected to the second engaging tab by a frangible connection provided at the free end of the distal portion.

8. An article carrier according to claim 1, wherein the first engaging tab comprises at least a portion formed from a recessed area of the second engaging tab such that the second engaging tab and a free end of the at least a portion of the first engaging tab engages the same article when the article carrier is in use.

9. An article carrier according to claim 8, wherein the second engaging edge of the second engaging tab is divided into two portions by the recessed area.

10. An article carrier according to claim 1 wherein, the first engaging tab comprises at least a portion formed from a recessed area of the second engaging tab, wherein the first engaging tab is disposed adjacent to a side panel hinged to the main panel.

11. An article carrier for packaging at least one article, the carrier comprising a first primary panel and at least one second primary panel each having at least one top-engaging device, each top-engaging device comprising at least a pair of opposing engaging tabs, each tab of the pair of opposing engaging tabs having a length greater than a half of the distance between their hinged connections to the respective one of the first and second primary panels.

12. An article carrier according to claim 11, wherein the first primary panel comprises at least one first top-engaging device and the at least one second primary panel has at least one second top-engaging device, the tabs of the at least one second top-engaging device are oriented perpendicularly to the tabs of the at least one first top-engaging device.

13. An article carrier according to claim 12, wherein the first primary panel comprises a tab receiving recess for receiving a respective one of the tabs of the at least one second top-engaging device.

14. An article carrier according to claim 13, wherein the tab receiving recess is defined between a pair of lobes.

15. An article carrier according to claim 13, wherein the tab receiving recess is defined in part by a portion of each of the pair of opposing engaging tabs in the first primary panel.

16. An article carrier according to claim 12, wherein the first primary panel comprises a pair of diametrically opposed tab receiving recesses, wherein each of the pair of diametrically opposed tab receiving recesses is defined in part by a portion of each of the pair of opposing engaging tabs in the first primary panel.

17. A blank for forming an article carrier, the blank comprising a main panel having at least one top-engaging device for engaging an article, the top-engaging device having an article receiving opening and at least a pair of opposing engaging tabs, wherein a first engaging tab of the pair of opposing engaging tabs is hingedly connected to the main panel by a first hinged connection and extends to a first engaging edge, the first engaging tab having a first length defined between the first engaging edge and the first hinged connection, wherein a second engaging tab of the pair of opposing engaging tabs is hingedly connected to the main panel by a second hinged connection and extends to a second engaging edge, the second engaging tab having a second length defined by the second engaging edge and the second hinge connection, wherein each of the first and second lengths is greater than half of the distance between the first and second hinged connections.

18. A blank according to claim 17, wherein each of the first and second engaging tabs extends from a proximal end thereof to a respective one of the first and second engaging edges, and wherein each of the first and second lengths is defined between the proximal end thereof and the respective one of the first and second engaging edges.

19. A blank according to claim 18 wherein the first engaging tab comprises a distal portion formed from the second engaging tab such that the distal portion remains in the plane of the remainder of the first engaging tab when a free end of the distal portion is brought into engagement with the at least one article in a setup carrier.

20. A blank according to claim 17 wherein the first engaging tab comprises at least a portion formed from a recessed area of the second engaging tab such that the second engaging tab and a free end of the at least a portion of the first engaging tab engages the same article when the article carrier is in use.

21. A blank according to claim 20, wherein the second engaging edge of the second engaging tab is divided into two portions by the recessed area.

22. A blank according to claim 17 wherein the first engaging tab comprises at least a portion formed from a recessed area of the second engaging tab, wherein the first engaging tab is disposed adjacent to a side panel hinged to the main panel.

23. A blank for forming an article carrier, the blank comprising a first primary panel and at least one second primary panel each having at least one top-engaging device, each top-engaging device comprising at least a pair of opposing engaging tabs, each tab of the pair of opposing engaging tabs having a length greater than a half of the distance between their hinged connections to the respective one of the first and second primary panels.

* * * * *